US006989824B1

(12) United States Patent
Ishii et al.

(10) Patent No.: US 6,989,824 B1
(45) Date of Patent: Jan. 24, 2006

(54) DRIVING METHOD FOR DRIVING ELECTRO-OPTICAL DEVICE, DRIVING CIRCUIT, ELECTRO-OPTICAL DEVICE, AND ELECTRONIC EQUIPMENT

(75) Inventors: Ryo Ishii, Suwa (JP); Akihiko Ito, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/743,768

(22) PCT Filed: May 15, 2000

(86) PCT No.: PCT/JP00/03116

§ 371 (c)(1),
(2), (4) Date: Jan. 18, 2001

(87) PCT Pub. No.: WO00/70594

PCT Pub. Date: Nov. 23, 2000

(30) Foreign Application Priority Data

May 14, 1999 (JP) ..... 11-134321

(51) Int. Cl.
*G09G 5/00* (2006.01)

(52) U.S. Cl. ..... 345/204; 345/87; 345/89; 345/94

(58) Field of Classification Search ..... 345/204, 345/60, 63, 87, 89, 94, 97, 100, 690, 691, 345/692

See application file for complete search history.

(56) References Cited

U.S. PATENT DOCUMENTS 5,614,922 A * 3/1997 Kawaguchi et al. ..... 345/89
5,712,651 A * 1/1998 Tomiyasu ..... 345/100
5,764,206 A 6/1998 Koyama et al.
5,861,863 A * 1/1999 Kudo et al. ..... 345/100
5,917,466 A 6/1999 Soda et al.
5,959,619 A * 9/1999 Kameyama et al. ..... 345/204
6,040,812 A * 3/2000 Lewis ..... 345/89
6,201,518 B1 * 3/2001 Kane et al. ..... 345/60
6,222,515 B1 * 4/2001 Yamaguchi et al. ..... 345/89
6,317,112 B1 * 11/2001 Handschy et al. ..... 345/89
6,323,880 B1 * 11/2001 Yamada ..... 345/690
6,326,938 B1 * 12/2001 Ishida et al. ..... 345/63
6,359,608 B1 3/2002 Lebrun et al.
6,414,654 B1 * 7/2002 Makino ..... 345/60
6,414,658 B1 * 7/2002 Tokunaga ..... 345/63
6,426,594 B1 * 7/2002 Ito ..... 315/169.1

FOREIGN PATENT DOCUMENTS

| | | |
|---|---|---|
| JP | 1-219887 | 9/1989 |
| JP | 3-20781 | 1/1991 |
| JP | 4-186282 | 7/1992 |
| JP | 04-211294 | 8/1992 |
| JP | A-5-35202 | 2/1993 |
| JP | A-5-281924 | 10/1993 |
| JP | A-6-95075 | 4/1994 |
| JP | 06-222330 | 8/1994 |
| JP | 7-49482 | 2/1995 |
| JP | 8-163472 | 6/1996 |
| JP | 8-305316 | 11/1996 |
| JP | A-9-127438 | 5/1997 |
| JP | A-10-31455 | 2/1998 |
| JP | A 10-214060 | 8/1998 |
| JP | A-11-2797 | 1/1999 |
| JP | 11-38928 | 2/1999 |
| JP | 11-125805 | 5/1999 |
| KR | 10-0310001 A | 9/2001 |
| WO | WO97/25706 | 7/1997 |

* cited by examiner

*Primary Examiner*—Guy J Lamarre
*Assistant Examiner*—Fritz Alphonse

(57) ABSTRACT

A signal applied to a data line is binarized to provide a high-quality gray scale presentation. To provide eight gray scales, for example, one field is divided into seven subfields in accordance with gray scale characteristics of an electro-optical device. Pixels are turned on or off by writing a high-level or a low-level signal thereon in a first subfield. In subsequent subfields, high-level or low-level signals are written depending on the gray scale level of each pixel to control the ratio of the on period of the pixels to the off period of the pixels on one field.

9 Claims, 15 Drawing Sheets

[FIG. 1]
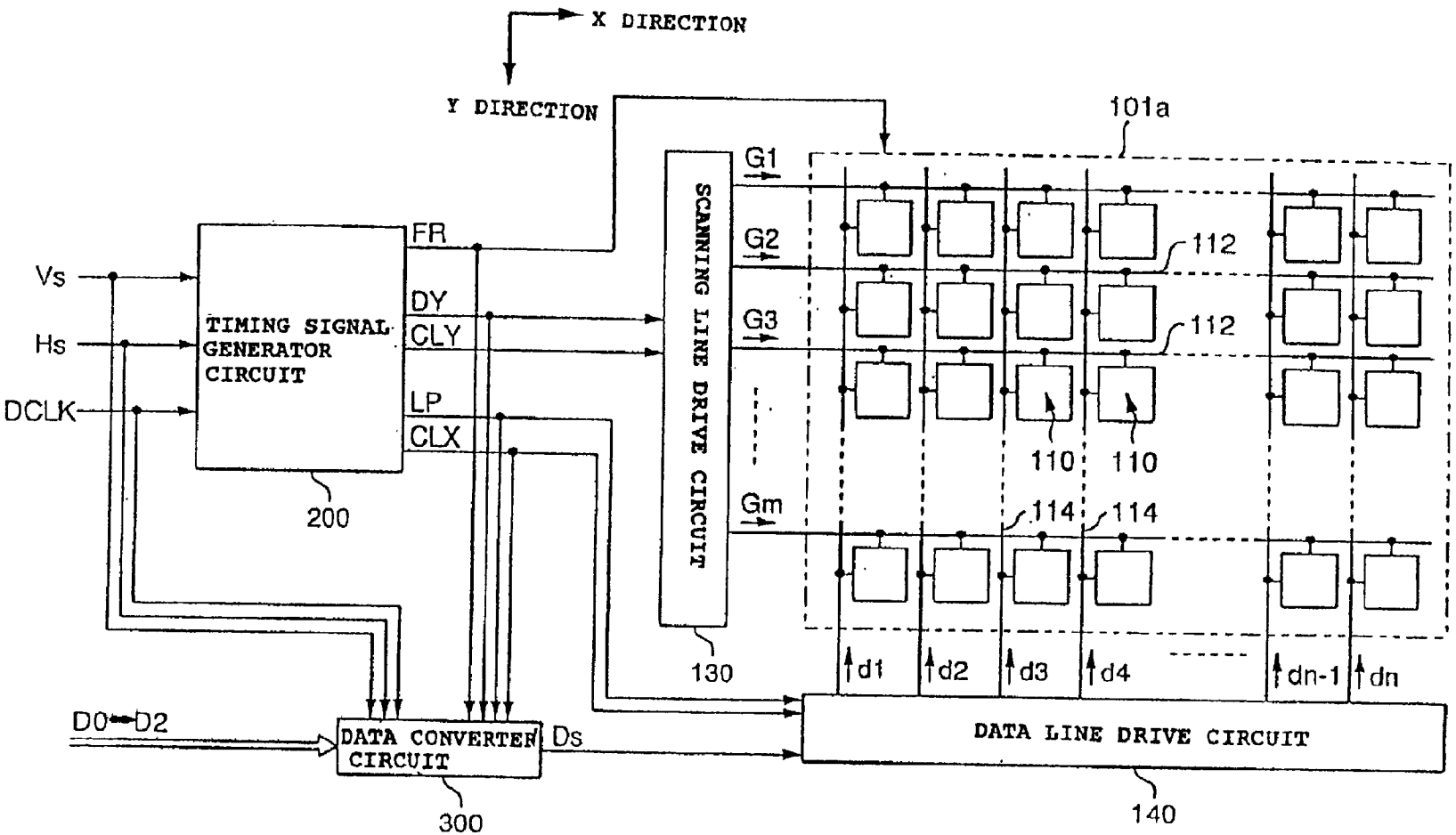

[FIG. 2]
(a)
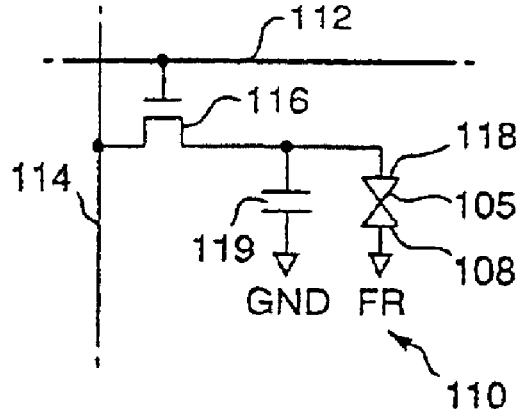
(b)
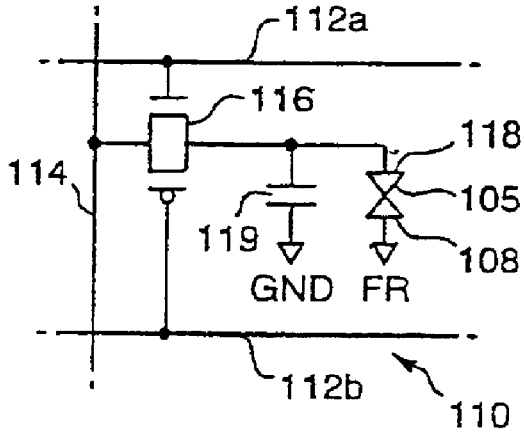

[FIG. 3]
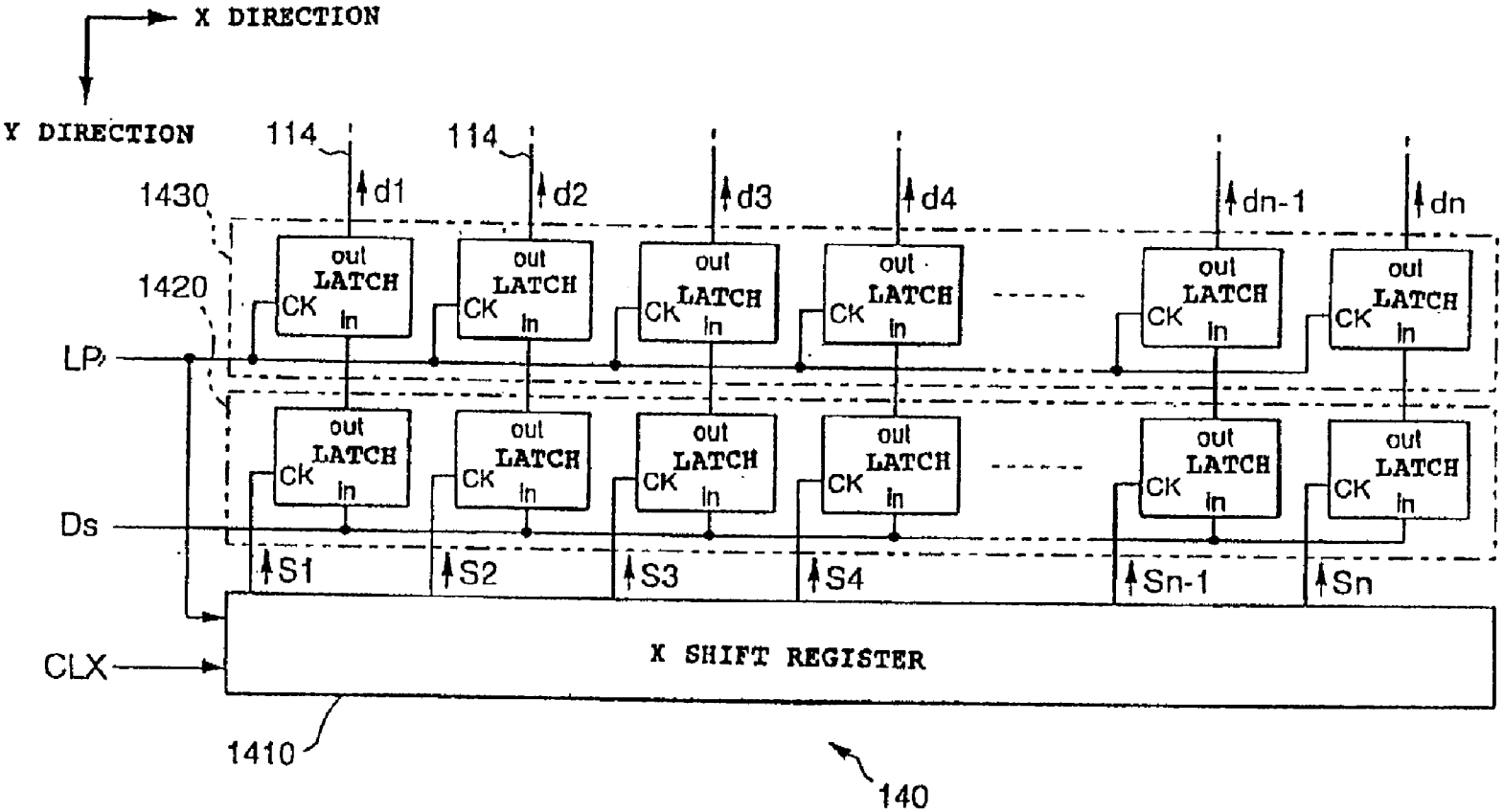

[FIG. 4]
(a)
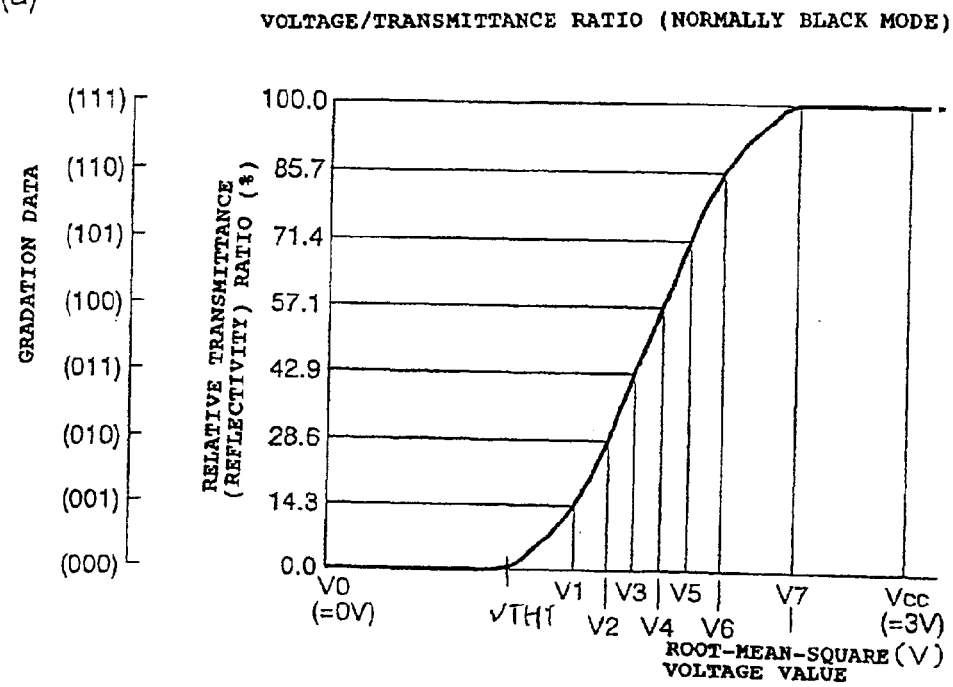
(b)
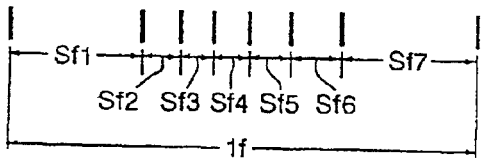

[FIG. 5]

(a) FR=L

| GRADATION DATA D0~D2 | Ds | | | | | | |
|---|---|---|---|---|---|---|---|
| | Sf1 | Sf2 | Sf3 | Sf4 | Sf5 | Sf6 | Sf7 |
| (000) | L | L | L | L | L | L | L |
| (001) | H | L | L | L | L | L | L |
| (010) | H | H | L | L | L | L | L |
| (011) | H | H | H | L | L | L | L |
| (100) | H | H | H | H | L | L | L |
| (101) | H | H | H | H | H | L | L |
| (110) | H | H | H | H | H | H | L |
| (111) | H | H | H | H | H | H | H |

(b) FR=H

| GRADATION DATA D0~D2 | Ds | | | | | | |
|---|---|---|---|---|---|---|---|
| | Sf1 | Sf2 | Sf3 | Sf4 | Sf5 | Sf6 | Sf7 |
| (000) | H | H | H | H | H | H | H |
| (001) | L | H | H | H | H | H | H |
| (010) | L | L | H | H | H | H | H |
| (011) | L | L | L | H | H | H | H |
| (100) | L | L | L | L | H | H | H |
| (101) | L | L | L | L | L | H | H |
| (110) | L | L | L | L | L | L | H |
| (111) | L | L | L | L | L | L | L |

[FIG. 6]
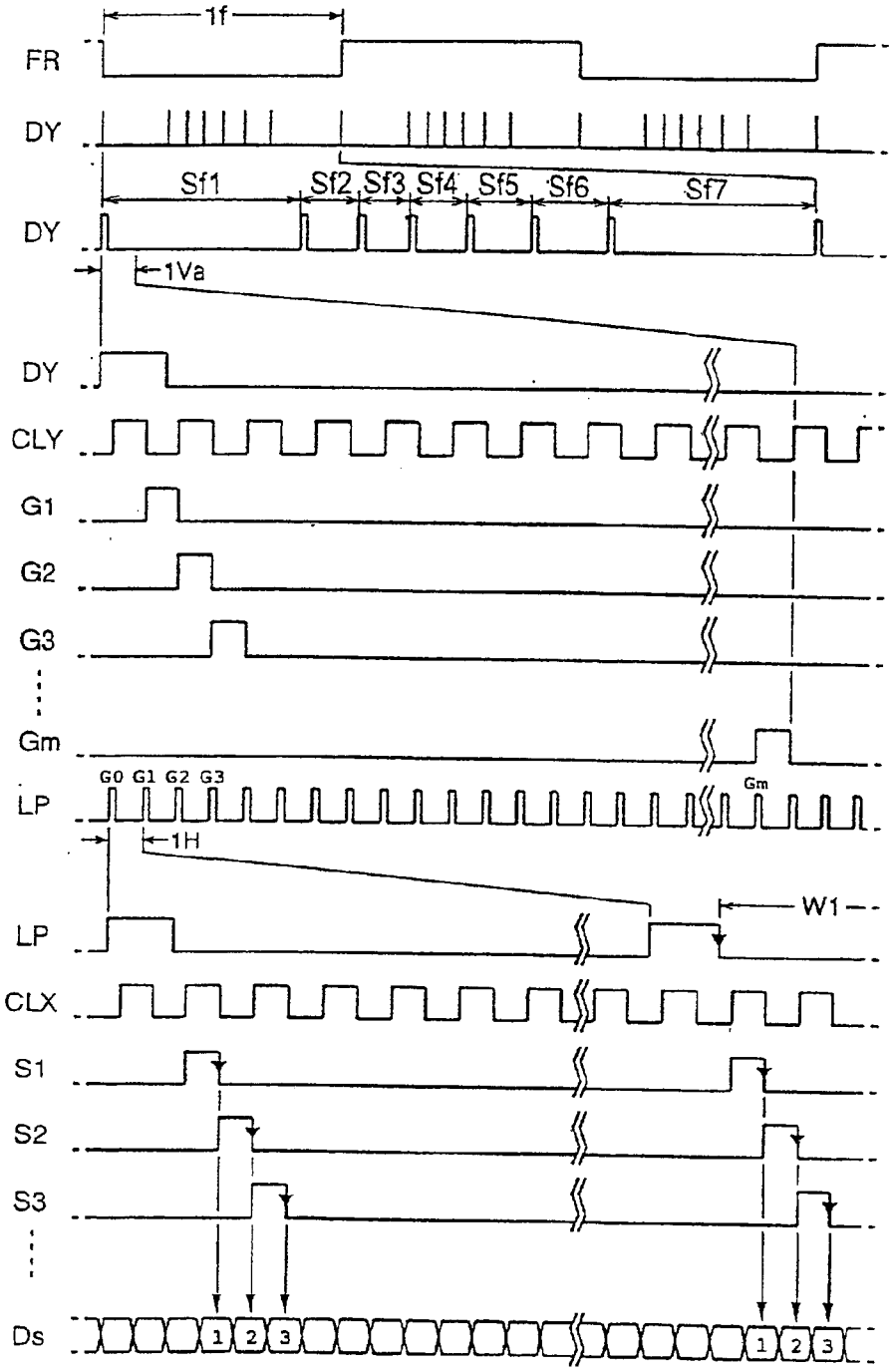

[FIG. 7]
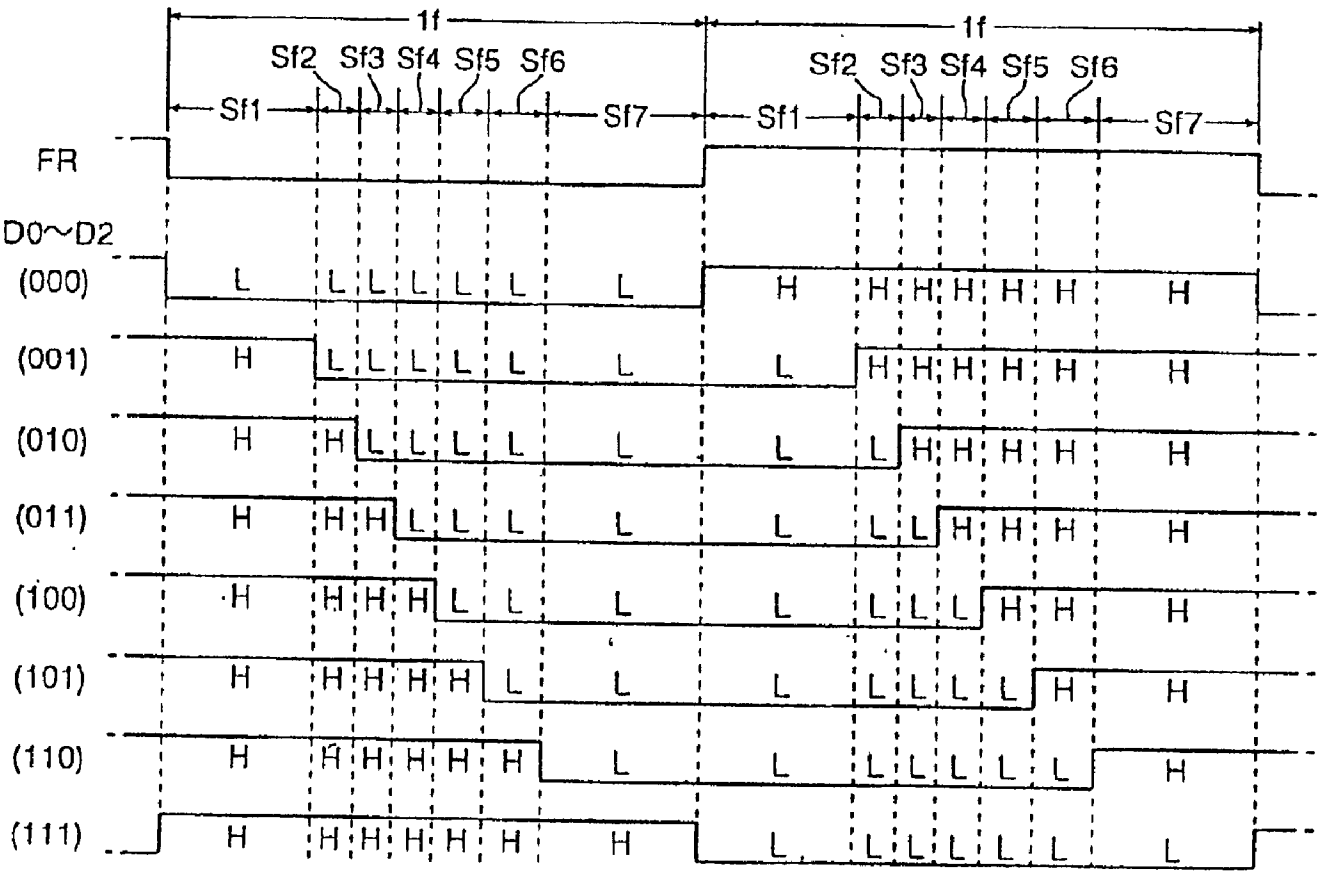

[FIG. 8]
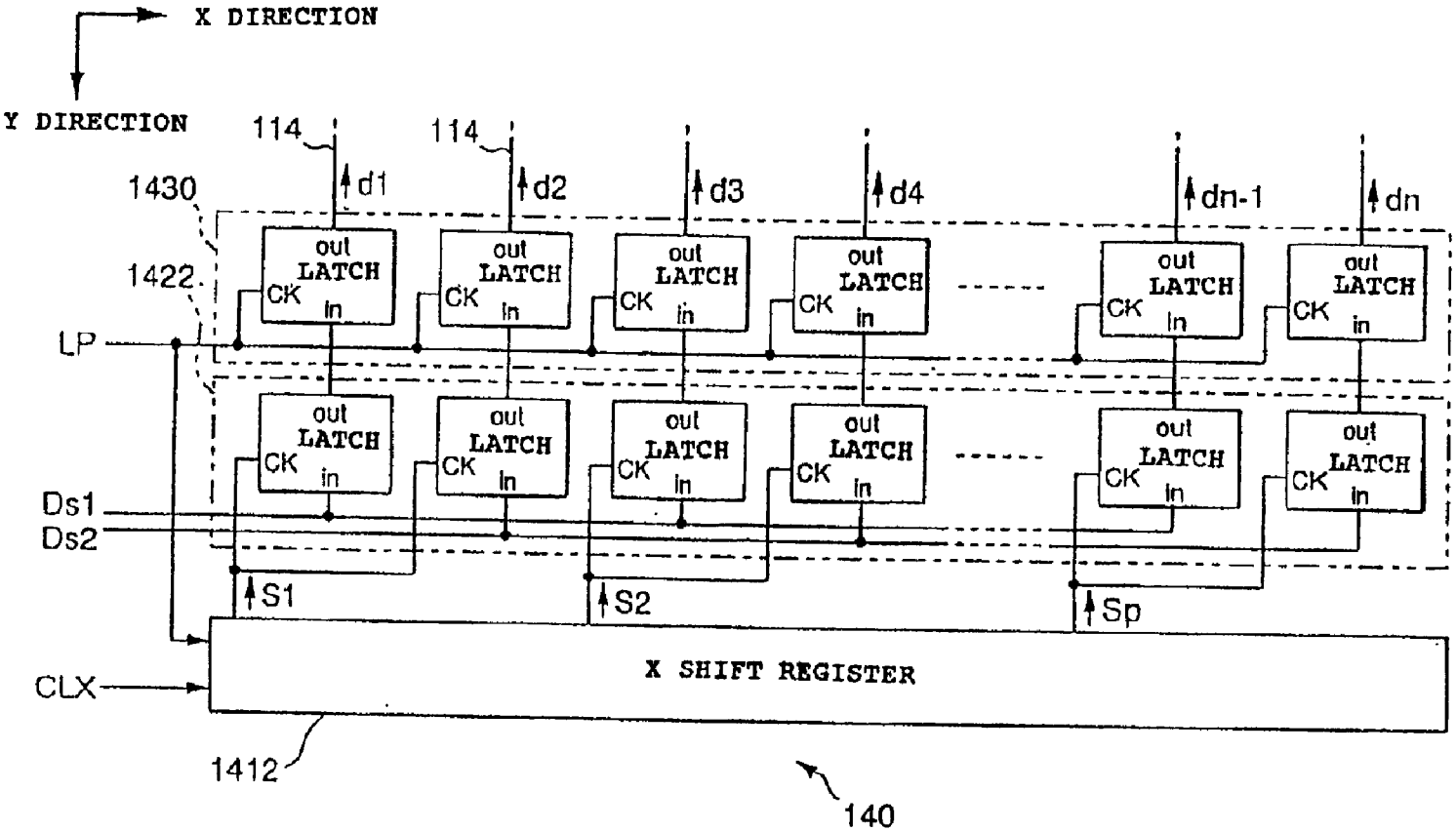

[FIG. 9]
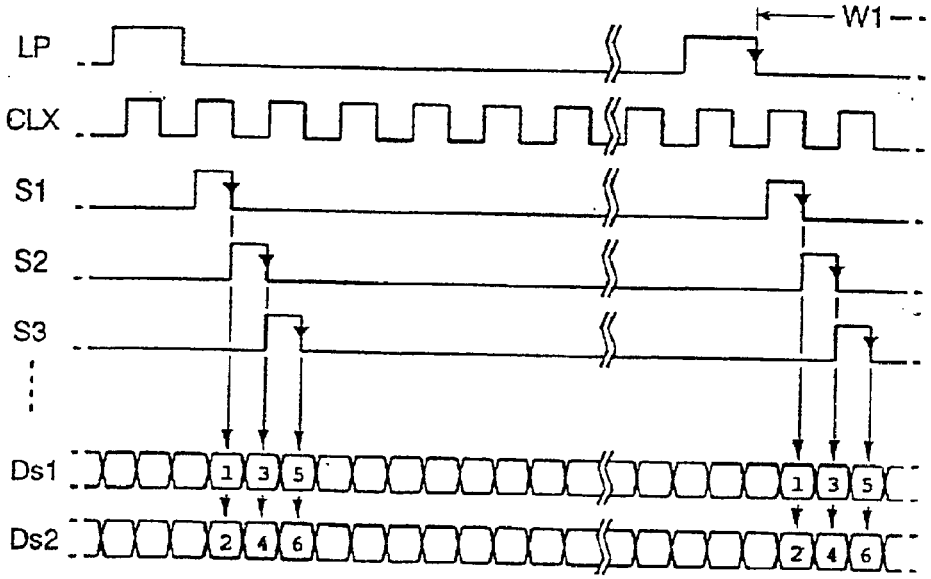

[FIG. 10]
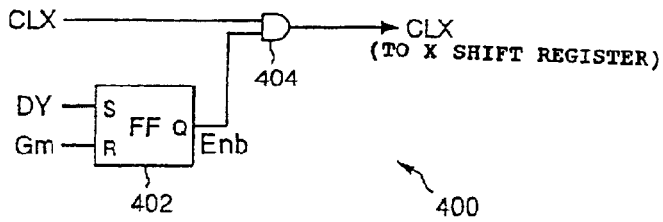
[FIG. 11]
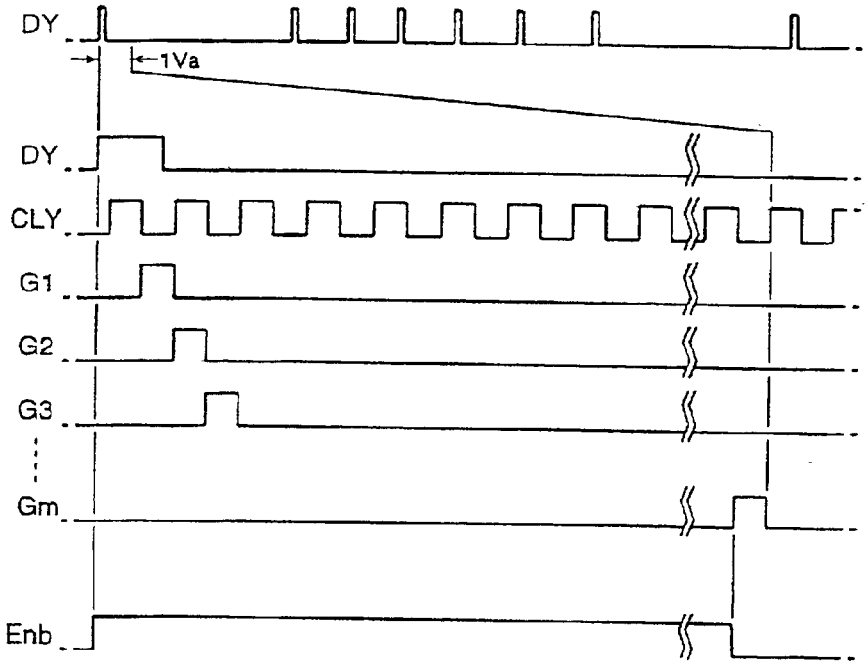

[FIG. 12]

(a) FR=L

| GRADATION DATA D0–D2 | Ds | | | |
|---|---|---|---|---|
| | Sf0 | Sf1 | Sf2 | Sf3 |
| (000) | L | L | L | L |
| (001) | H | H | L | L |
| (010) | H | L | H | L |
| (011) | H | H | H | L |
| (100) | H | L | L | H |
| (101) | H | H | L | H |
| (110) | H | L | H | H |
| (111) | H | H | H | H |

(b) FR=H

| GRADATION DATA D0–D2 | Ds | | | |
|---|---|---|---|---|
| | Sf0 | Sf1 | Sf2 | Sf3 |
| (000) | H | H | H | H |
| (001) | L | L | H | H |
| (010) | L | H | L | H |
| (011) | L | L | L | H |
| (100) | L | H | H | L |
| (101) | L | L | H | L |
| (110) | L | H | L | L |
| (111) | L | L | L | L |

[FIG. 13]
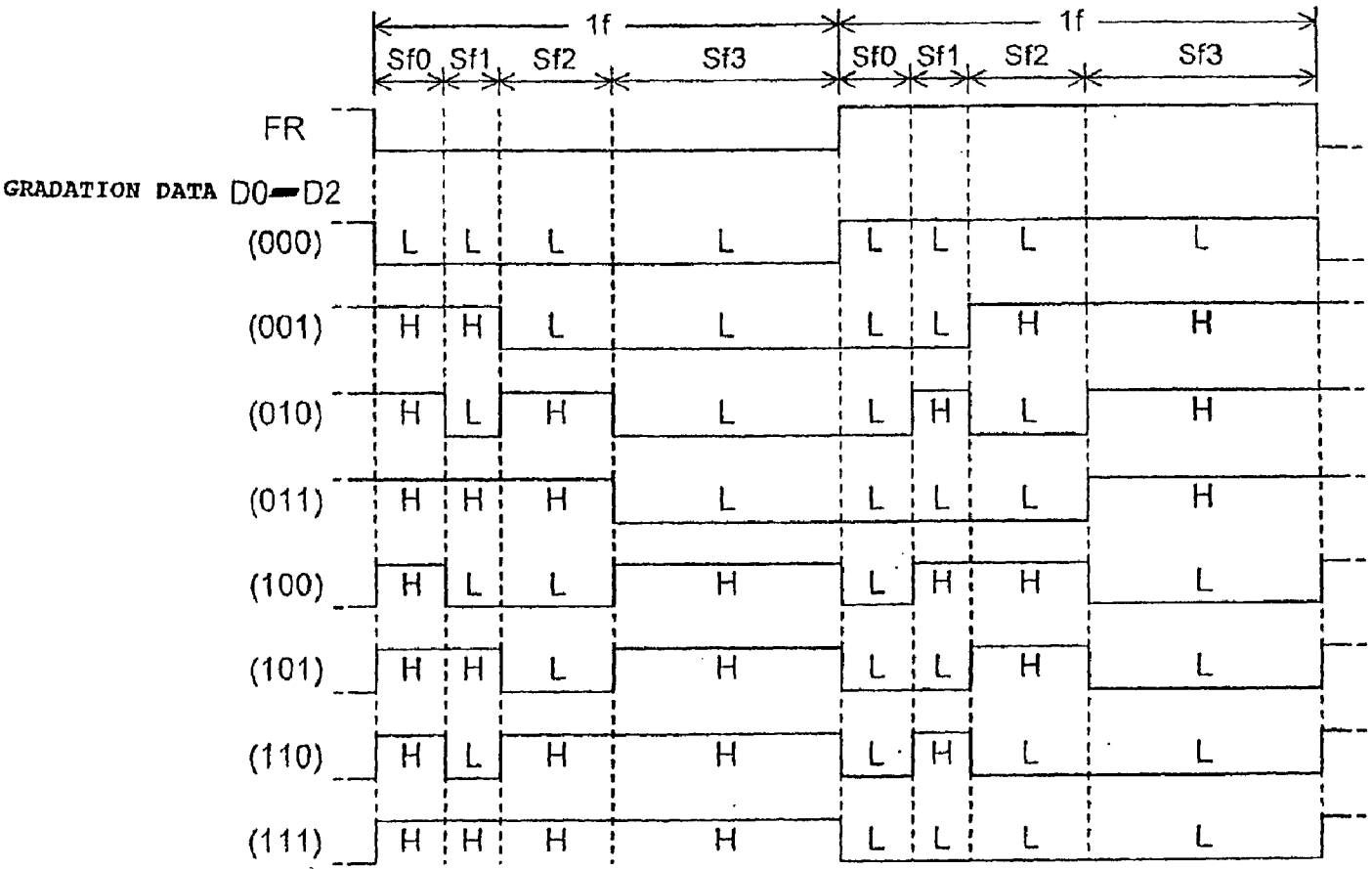

[FIG. 14]
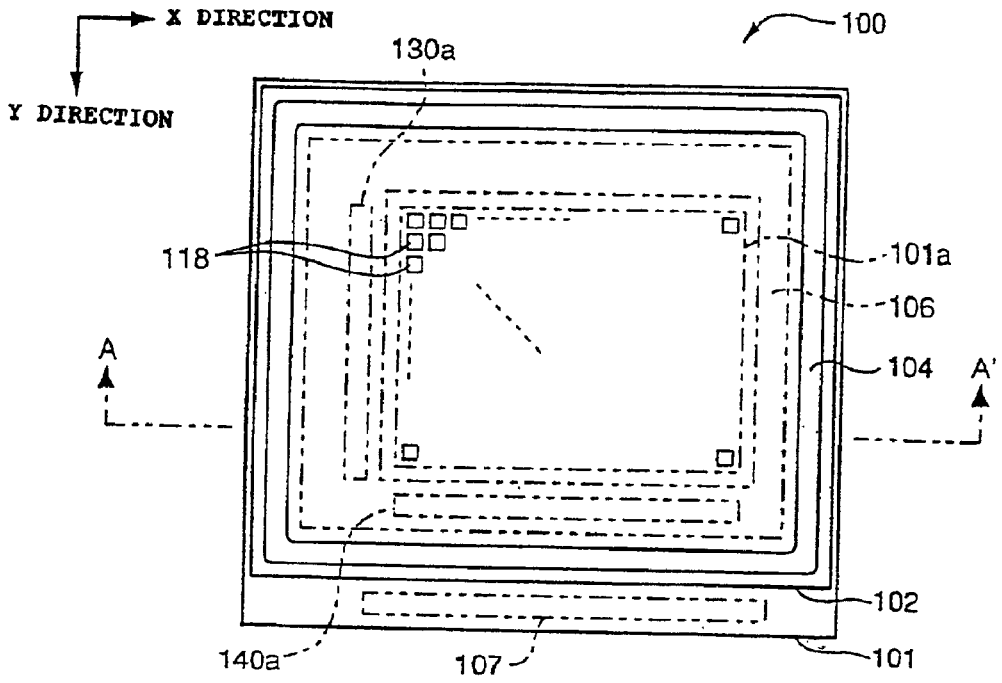
[FIG. 15]
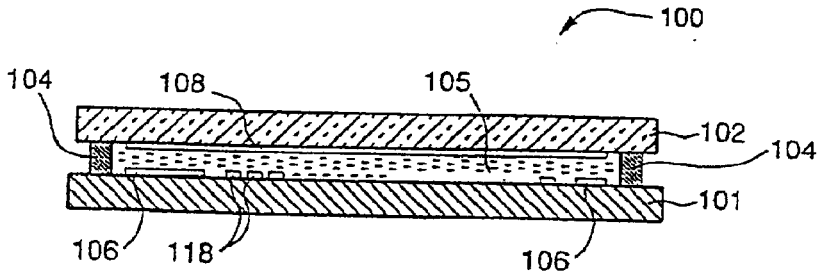

[FIG. 16]
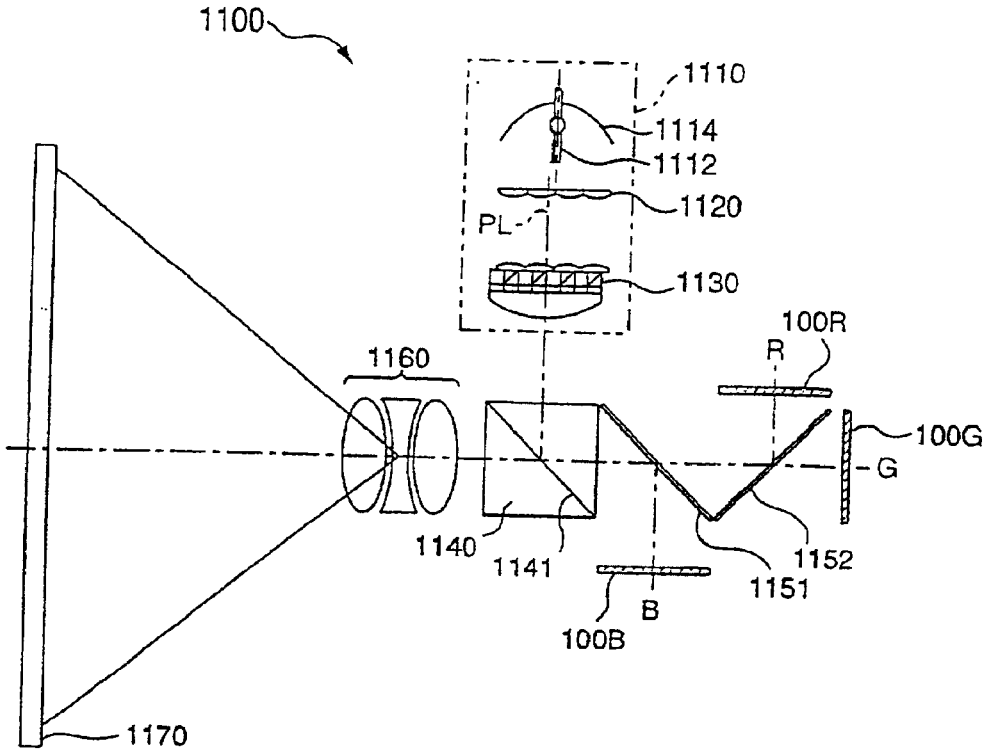
[FIG. 17]
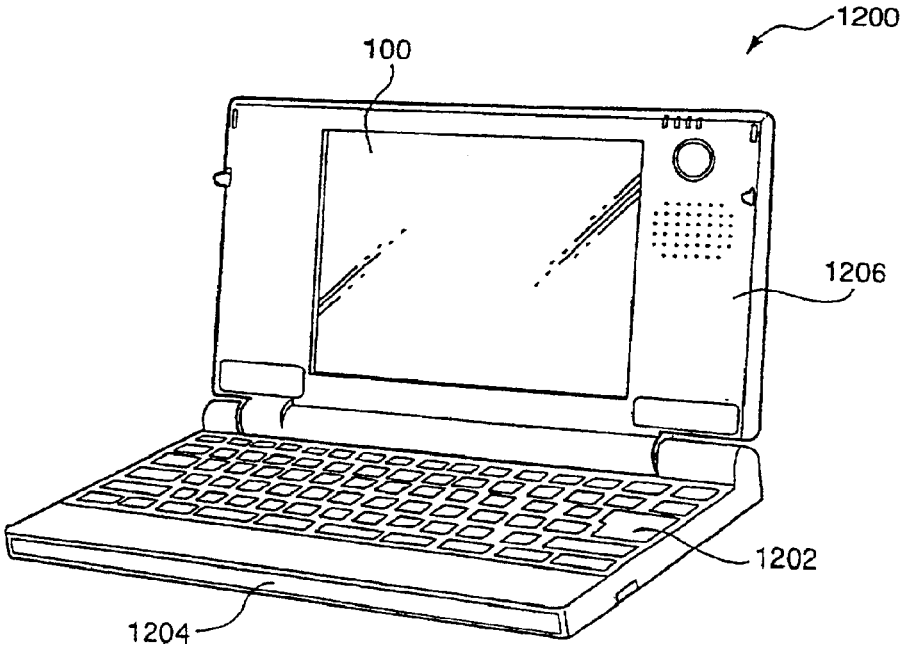

[FIG. 18]
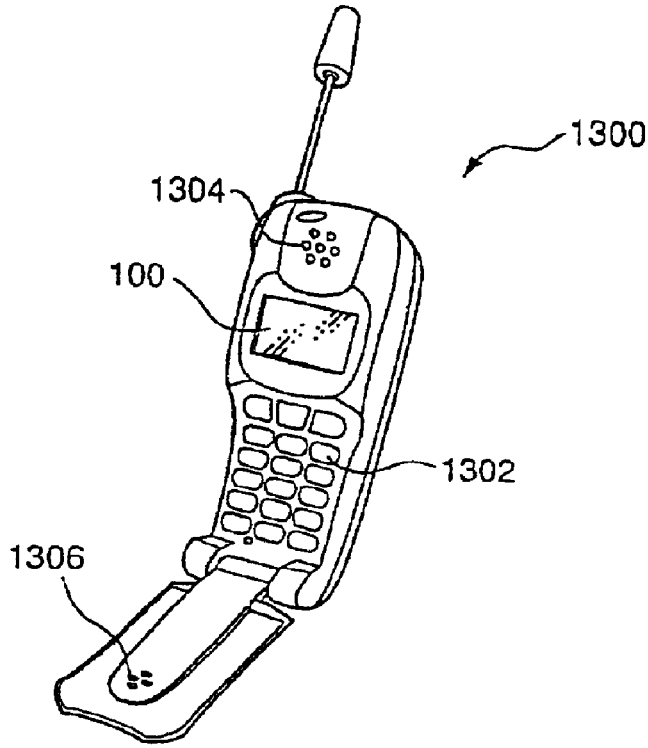

DRIVING METHOD FOR DRIVING ELECTRO-OPTICAL DEVICE, DRIVING CIRCUIT, ELECTRO-OPTICAL DEVICE, AND ELECTRONIC EQUIPMENT

BACKGROUND OF THE INVENTION

1. Field of the Invention

The present invention relates to a driving method for driving an electro-optical device that performs gray scale display control through pulse-width modulation, a driving circuit for the electro-optical device, and electronic equipment.

2. Description of Related Art

Electro-optical devices, such as a liquid-crystal display device employing a liquid crystal as an electro-optical material, are now replacing cathode ray tubes (CRTs), and are widely used as a display of a variety of information processing apparatuses or of wall-mounted television sets.

A conventional electro-optical device typically includes an element substrate on which a matrix of pixel electrodes and switching elements, such as TFTs (Thin-Film Transistors), respectively connected to the pixel electrodes, are formed, an opposite substrate on which an opposite electrode, opposed to the pixel electrodes, is formed, and a liquid crystal, as an electro-optical material, encapsulated between the two substrates. With this arrangement, when a scanning signal is applied to the switching element through a scanning line, the switching element becomes conductive. When the pixel electrode is applied with an image signal having a voltage responsive to the gray scale thereof through a data line during the conductive state of the switching element, a charge responsive to the voltage of the image signal is stored in a liquid crystal layer between the pixel electrode and the counter electrode. Even if the switching element is turned off subsequent to the storage of the charge, the storage of the charge is maintained in the liquid crystal layer by capacitance of the liquid crystal itself and a storage capacitor formed between the two substrates. When each switching element is driven and the stored charge is controlled in accordance with the gray scale, the alignment of the liquid crystal in each pixel changes, and brightness can be controlled from pixel to pixel. A gray scale display thus results.

Since a period of time during which the charge is stored in the liquid crystal layer in each pixel is part of a scanning period, a time-division multiplex driving method becomes possible in which a plurality of pixels share the same scanning line or the same data line. In this driving method, first, a scanning line driving circuit sequentially selects the scanning lines, second, a data line driving circuit sequentially selects the data lines during a selection period of the scanning line, and third, the selected data line thus samples the image signal having a voltage responsive to the gray scale thereof.

SUMMARY OF THE INVENTION

The image signal applied to the data line has a voltage responsive to the gray scale thereof, i.e., is an analog signal. For this reason, the electro-optical device requires peripheral circuits such as a digital-to-analog converter, and an operational amplifier, and the overall cost of the device is increased. Due to nonuniformities in the characteristics of the digital-to-analog converter and the operational amplifier, and resistance of a variety of lines, display nonuniformities arise. Presenting a high-quality image becomes difficult. Such nonuniformities becomes pronounced particularly when a high-definition display is presented.

In view of the problems, the present invention has been developed, and it is an object of the present invention to provide an electro-optical device that offers a high-quality and high-definition gray scale display, a method for driving the electro-optical device, a driving circuit for driving the electro-optical device, and electronic equipment incorporating the electro-optical device.

To achieve the above object, a first invention relates to a driving method for driving an electro-optical device having a matrix of pixels to display an image with gray scale, and includes the steps of dividing each field into a plurality of subfields, and supplying each pixel with a voltage that sets the pixels to a ON state on a subfield-by-subfield basis or a voltage that sets the pixels to an OFF state on a subfield-by-subfield basis so that a ratio of a period of voltage application time to set the pixels to the ON state to a period of voltage application time to set the pixels to the OFF state in each field is responsive to the gray scale level of the pixel.

In the first invention time lengths of subfields divided from one field are long enough so as to feed different root-mean-square voltages to the pixels every different subfields.

A second invention relates to a driving method for driving an electro-optical device having a matrix of pixels to display an image with gray scale, and includes the steps of dividing each field into a plurality of subfields, setting the pixels to an ON state or an OFF state during a first subfield, and controlling each pixel depending on the gray scale level of the pixel as to whether to remain in the ON state or the OFF state of the pixels during subsequent subfields.

In accordance with the first invention and the second invention, the on (off) period of the pixel is pulse-width modulated with the gray scale level of the pixel during one field, and gray scale display is thus controlled by a root-mean-square value. In each subfield, it suffices to command each pixel to turn on or off, and as a command signal to each pixel, a binary signal (i.e., a digital signal which takes only two levels of a high level and a low level) is used. In the first invention and the second invention, the signal applied to the pixel is a digital signal, and display nonuniformities due to irregularities in element characteristics and wiring resistance are controlled. A high-quality and high-definition gray scale display thus results.

In the context of the present invention, one field refers to a period of time required to form one raster image which is obtained by performing a horizontal scanning and a vertical scanning respectively in synchronization with a horizontal scanning signal and a vertical scanning signal. Therefore, one frame in a non-interlace system is thus treated as one field in the context of the present invention.

In one embodiment of the first invention or the second invention, each pixel is arranged as to correspond to an intersection where one of a plurality of scanning lines and one of a plurality of data lines cross, and is set to the ON state or to the OFF state depending on a voltage supplied to the data line for a period during which the scanning line is applied with a scanning signal, the scanning signal is supplied to the scanning lines on a subfield-by-subfield basis, and a binary signal for commanding the pixel to be set to the ON state or the OFF state is fed to the data line of the pixel for a period during which the scanning line of the pixel is supplied with the scanning signal. In this embodiment, when the scanning line is supplied with the scanning signal and when the data line, perpendicular to the scanning line, is supplied with the binary signal, the pixel corresponding to that intersection is turned on and off in response to the binary signal. In this embodiment, this operation is performed on all pixels.

To achieve the above object, a third embodiment relates to a driving circuit of an electro-optical device for driving pixels including a pixel electrode corresponding to each intersection at which one of a plurality of scanning lines and one of a plurality of data lines cross, and a switching element for controlling a voltage supplied to each pixel electrode, and the driving circuit includes a scanning line driving circuit for supplying the scanning line with a scanning signal that turns on the switching element in each of a plurality of subfields divided from one field, and a data line driving circuit for supplying the data line of the pixel with a binary signal commanding the pixel to be set to the ON state or the OFF state for a period during which the scanning line of the pixel is supplied with the scanning signal, wherein the binary signal is a command signal to set the pixel to the ON state or to the OFF state so that a ratio of a period of voltage application time to set the pixels to the ON state to a period of voltage application time to set the pixels to the OFF state in each field is responsive to the gray scale level of the pixel.

A fourth invention relates to a driving circuit of an electro-optical device for driving pixels including a pixel electrode at each intersection at which one of a plurality of scanning lines and one of a plurality of data lines cross, and a switching element for controlling a voltage supplied to each pixel electrode, and the driving circuit includes a scanning line driving circuit for supplying the scanning line with a scanning signal that turns on the switching element in each of a plurality of subfields divided from one field, and a data line driving circuit for supplying the data line of the pixel with a binary signal for a period during which the scanning line of the pixel is supplied with the scanning signal, wherein the binary signal commands the pixels to be set to an ON state or an OFF state during a first subfield, and commands the pixels as to whether to remain in the ON state or the OFF state during a subsequent subfield.

Like the first and second inventions, the third and fourth inventions apply a digital signal to each pixel, and display nonuniformities due to irregularities in element characteristics and wiring resistance are controlled. A high-quality and high-definition gray scale display thus results.

In accordance with the third and fourth inventions, preferably, the data line driving circuit further includes a shift register for sequentially shifting a latch pulse signal, supplied at the start of a horizontal scanning period, in response to a clock signal, a first latch circuit for sequentially latching the binary signal in response to the shifted signal provided by the shift register, and a second latch circuit which latches the binary signal, latched by the first latch circuit, in response to the latch pulse signal while simultaneously outputting the latched binary signals to the corresponding data lines. Since one field is divided into a plurality of subfields in this invention, a write time to each pixel could be insufficient when a binary signal is supplied in a point at a time scanning in each subfield. With this arrangement, before the binary signal is fed to the data lines, the first latch circuit latches in a point at a time scanning, and all latched signals are then latched at a time by the second latch circuit in response to the latch pulse signal that is supplied at the start of the horizontal scanning period and are then supplied to the data lines. With this arrangement, one horizontal scanning period, which is a relatively long time, is assured as the write time for the pixels.

With this arrangement, preferably, the first latch circuit simultaneously latches the binary signals, which are branched into a plurality of lines from a single line, in response to the shifted signal provided by the shift register. In this arrangement, a number of stages of the shift register is reduced, and a period of time the first latch circuit requires to latch the binary signals is thus reduced.

With the shift register incorporated in the data line driving circuit, the electro-optical device preferably includes a clock signal supply control circuit, which stops the supply of the clock signal to the shift register after the scanning line driving circuit supplies all scanning lines with the scanning signal in one subfield, and restarts the supply of the clock signal at the start of a subsequent subfield. Since the shift register typically includes a number of clocked inverters which receive the clock signal at the gates thereof, the shift register works as a capacitive load if viewed from the source side of the clock signal. There is no need for operating the shift register on the data line side for a period from "when the scanning line driving circuit has fed the scanning signal to all scanning lines" to "when a next subfield starts". The clock signal supply control circuit thus stops the supply of the clock signal to the shift register for this period, thereby reducing the power consumed by the capacitive load of the shift register.

To achieve the above object, a fifth invention relates to an electro-optical device and includes a pixel including a pixel electrode at each intersection at which one of a plurality of scanning lines and one of a plurality of data lines cross, a switching element for controlling a voltage applied to each pixel electrode, and a counter electrode arranged to be opposed to the pixel electrode, a scanning line driving circuit for supplying the scanning line with a scanning signal that turns on the switching element in each of a plurality of subfields divided from one field, and a data line driving circuit for supplying the data line of the pixel with a binary signal for a period during which the scanning line of the pixel is supplied with the scanning signal, wherein the binary signal is a command signal to set the pixels to the ON state or to the OFF state so that a ratio of a period of voltage application time to set the pixels to the ON state to a period of voltage application time to set the pixels to the OFF state in each field is responsive to the gray scale level of the pixel.

A sixth invention relates to an electro-optical device and includes a pixel including a pixel electrode at each intersection at which one of a plurality of scanning lines and one of a plurality of data lines cross, a switching element for controlling a voltage applied to each pixel electrode, and a counter electrode arranged to be opposed to the pixel electrode, a scanning line driving circuit for supplying the scanning line with a scanning signal that turns on the switching element in each of a plurality of subfields divided from one field, and a data line driving circuit for supplying the data line of the pixel with a binary signal for a period during which the scanning line of the pixel is supplied with the scanning signal, wherein the binary signal commands the pixel to be set to an ON state or an OFF state during a first subfield, and commands the pixel as to whether to remain in the ON state or the OFF state of the pixel during a subsequent subfield.

Like the first and second inventions, the fifth and sixth inventions apply a digital signal to each pixel, and display nonuniformities due to irregularities in element characteristics and wiring resistance are controlled. A high-quality and high-definition gray scale display thus results.

In the fifth and sixth inventions, the binary signal is preferably shifted in level in response to the level of a voltage applied to the counter electrode. With this arrangement, the counter electrode is biased to one level at one time and to the other level at other times. With respect to a reference point set to an intermediate level between the two levels, the voltage applied to the pixel is inverted in polarity when the counter electrode is shifted from the one level to the other, but the absolute values of the voltage of the pixel remains unchanged. This arrangement prevents a direct current component from being applied to the electro-optical material encapsulated between the pixel electrode and the counter electrode.

In one embodiment of the fifth invention or the sixth invention, preferably, an element substrate on which the pixel electrode and the switching element are formed is fabricated of a semiconductor substrate, the scanning line driving circuit and the data line driving circuit are produced on the element substrate, and the pixel electrode has reflectivity. With high electron mobility of the semiconductor substrate, the switching element and other elements constituting a driving circuit, formed on the substrate, provide a fast response while permitting a compact design to be introduced. Since the semiconductor substrate is opaque, the electro-optical device is used as a reflective type.

To achieve the above object, a seventh invention relates to electronic equipment, and includes the above-referenced electro-optical device. With neither digital-to-analog converter nor operational amplifier employed, the electro-optical device is free from the characteristics of the digital-to-analog converter and the operational amplifier, and the effect of nonuniformities in wiring resistance. The electronic equipment not only becomes low-cost, but also presents a high-quality and high-definition gray scale display.

BRIEF DESCRIPTION OF THE DRAWINGS

FIG. 1 is a block diagram showing the electrical construction of an electro-optical device of one embodiment of the present invention.

FIGS. 2(*a*) and 2(*b*) are circuit diagrams of one embodiment of a pixel of the electro-optical device.

FIG. 3 is a block diagram showing the construction of a data line driving circuit in the electro-optical device.

FIG. 4(*a*) is a graph showing voltage-transmittance ratio characteristics of the electro-optical device, and FIG. 4(*b*) is a diagram showing the concept of a subfield in the electro-optical device.

FIGS. 5(*a*) and 5(*b*) are tables respectively listing converted content of gray scale data of a data converter circuit in the electro-optical device.

FIG. 6 is a timing diagram showing the operation of the electro-optical device.

FIG. 7 is a timing diagram showing a voltage applied to a counter substrate and a voltage applied to a pixel electrode during a field in the electro-optical device.

FIG. 8 a block diagram showing a modification of the data line driving circuit of the electro-optical device.

FIG. 9 is a timing diagram showing the operation of the data line driving circuit in accordance with the modification.

FIG. 10 is a circuit diagram showing a clock signal supply control circuit in a modification of the electro-optical device.

FIG. 11 is a timing diagram showing the operation of the clock signal supply control circuit.

FIGS. 12(*a*) and 12(*b*) are tables respectively listing converted content of gray scale data of a data converter circuit in the electro-optical device.

FIG. 13 is a timing diagram showing a voltage applied to a counter substrate and a voltage applied to a pixel electrode during a field in the modification of the electro-optical device.

FIG. 14 is a plan view showing the construction of the electro-optical device.

FIG. 15 is a sectional view showing the construction of the electro-optical device.

FIG. 16 is a sectional view showing the construction of a projector which is one example of electronic equipment incorporating the electro-optical device.

FIG. 17 is a perspective view showing a personal computer as one example of electronic equipment incorporating the electro-optical device.

FIG. 18 is a perspective view showing a portable telephone as one example of electronic equipment incorporating the electro-optical device.

REFERENCE NUMERALS

100 . . . Electro-optical device
101 . . . Element substrate
101*a* . . . Display area
102 . . . Counter substrate
105 . . . Liquid crystal (electro-optical material)
108 . . . Counter electrode
112 . . . Scanning line
114 . . . Data line
116 . . . Transistor
118 . . . Pixel electrode
119 . . . Storage capacitor
130 . . . Scanning line driving circuit
140 . . . Data line driving circuit
1410 . . . X shift register
1420 . . . First latch circuit
1430 . . . Second latch circuit
200 . . . Timing signal generator circuit
300 . . . Data converter circuit
400 . . . Clock signal supply control circuit.

DETAILED DESCRIPTION OF THE EMBODIMENTS

The embodiments of the present invention are now discussed, referring to the drawings. The electro-optical device of the embodiments is a liquid crystal device employing a liquid crystal as an electro-optical material, and as will discussed later, an element substrate and a counter substrate are arranged to be opposed to each other with a constant gap maintained therebetween, and the liquid crystal as the electro-optical material is encapsulated therebetween. The electro-optical device of the embodiments employs a semiconductor substrate as the element substrate, and peripheral driving circuits are produced on the element substrate together with transistors driving pixels.

Electrical Construction

FIG. 1 is a block diagram showing the electrical construction of the electro-optical device. As shown, a timing signal generator circuit 200 generates a variety of timing signals and clock signals to be discussed later, in response to a vertical scanning signal Vs, a horizontal scanning signal Hs, and a dot clock signal DCLK supplied by an unshown control unit. First, an alternating driving signal FR, inverted in polarity every field (every frame), is applied to the counter electrode formed on the counter substrate. Second, a start pulse DY is a pulse signal that is output first in each of subfields into which one field is divided, as will be described later. Third, a clock signal CLY is a signal that defines a horizontal scanning period of a scanning side (Y side). Fourth, a latch pulse LP is a pulse signal, which is output first in a horizontal scanning period, is output during a level transition (i.e., at a rising edge or a falling edge) of the clock signal CLY. Fifth, a clock signal CLX is a signal that defines a so-called dot clock.

A plurality of scanning lines 112 extend on a display area 101*a* on the element substrate in the X (row) direction, and a plurality of data lines 114 extend on the display area 101*a* in the Y (column) direction. A matrix of pixels 110 is arranged, each pixel at an intersection of one scanning line 112 and one data line 114. For simplicity of discussion, in this embodiment, a number of total scanning lines 112 is set to be n, and a number of total data lines 114 is set to be n (each of m and n is an integer greater than 1). The present invention is discussed in connection with a matrix-type display having a matrix of m rows by n columns, but this is not intended to limit the present invention to this arrangement.

A specific construction of the pixel 110 is shown in FIG. 2(*a*). In this construction, a (MOSFET) transistor 116 is configured with the gate thereof connected to the scanning line 112, with the source thereof connected to the data line 114, and the drain thereof connected to the pixel electrode 118, and a liquid crystal 105 as an electro-optical material is encapsulated between pixel electrodes 118 and a counter electrode 108, thereby forming a liquid-crystal layer. As will be discussed later, the counter electrode 108 is a transparent electrode that fully covers the counter substrate in a manner such that the counter electrode 108 is opposed to the pixel electrodes 118.

In typical electro-optical devices, the counter electrode 108 is maintained at a constant voltage, but in the electro-optical device of this embodiment, the alternating driving signal FR is applied to invert the polarity of the counter electrode 108 every field. A storage capacitor 119 is formed between the pixel electrode 118 and ground potential GND, thereby preventing leakage of charge stored in the liquid-crystal layer.

Since the arrangement shown in FIG. 2(*a*) employs a single channel type as the transistor 116, the effect of an offset voltage needs to be considered to compensate for a drop in a voltage applied to the pixel electrode 118 caused by a parasitic capacitor formed between the gate and the drain of the transistor 116. If the pixel includes a P-channel transistor and an N-channel transistor configured in a complementary fashion as shown in FIG. 2(*b*), the effect of the offset voltage is canceled out. However, since the complementary construction requires that voltages mutually opposite in phase be supplied as the scanning signal, a single pixel 110 needs two scanning lines 112*a* and 112*b*.

The construction of the pixel is not limited to the ones shown in FIG. 2(*a*) and FIG. 2(*b*). A memory cell, such as an SRAM, is formed in each pixel using a transistor and a resistor, and the pixel may be thus controlled to an ON state or an OFF state in response to the data of a high level or a low level written onto the memory cell. Such an arrangement advantageously eliminates the need for addressing all pixels on a subfield by subfield basis as will be discussed later. Specifically, it suffices to supply a scanning signal to a scanning line which is connected to the pixel having data which need to be updated in the memory thereof, rather than supplying the scanning signal to all scanning lines.

Returning to FIG. 1, a scanning line driving circuit 130 is a so-called Y shift register, and transfers the start pulse DY, which is supplied first in a subfield, to the scanning lines 112 as scanning signals G1, G2, G3, . . . , Gm in response to the clock signal CLY.

A data line driving circuit 140 sequentially latches n binary signals Ds, a number of which equals the number of the data lines 114, during one horizontal scanning period, and then respectively supplies latched data signals d1, d2, d3, . . . , dn to the corresponding data lines 114 at a time during a next horizontal scanning period. The specific construction of the data line driving circuit 140 is shown in FIG. 3. Specifically, the data line driving circuit 140 includes an X shift register 1410, a first latch circuit 1420, and a second latch circuit 1430. The X shift register 1410 transfers the latch pulse LP, which is supplied at the start of the horizontal scanning period, in response to the clock signal CLX, thereby sequentially supplying latch signals S1, S2, S3, . . . , Sn. The first latch circuit 1420 sequentially latches the binary signal Ds at the falling edges of the latch signals S1, S2, S3, . . . , Sn. The second latch circuit 1430 simultaneously latches the binary signals Ds, latched by the first latch circuit 1420, at the falling edge of the latch pulse LP, while feeding data signals d1, d2, d3, . . . , dn to the respective data lines 114.

Before discussing the data converter circuit 300, the concept of the subfield in the electro-optical device of this embodiment is discussed. The relationship between the voltage applied to the liquid-crystal layer and a relative transmittance (or reflectance) ratio of the liquid-crystal layer is something like the one shown in FIG. 4(*a*) in a normally-black mode which presents a black display with no voltage applied in the liquid-crystal device employing a liquid crystal as an electro-optical material. The relative transmittance ratio refers to the one normalized with the minimum and the maximum of transmitted light quantity respectively set to zero % and 100%. Referring to FIG. 4(*a*), the transmittance ratio of the liquid-crystal device is zero % when the voltage applied to the liquid-crystal layer is smaller than a threshold voltage VTH1. The transmittance ratio increases nonlinearly with the applied voltage when the applied voltage is not lower than the threshold voltage VTH1 but not higher than a saturation voltage VTH2 (=V7). When the applied voltage is higher than the saturation voltage VTH2, the transmittance ratio stays at a constant regardless of the applied voltage. When defining the transmittance (reflectance) ratio of the liquid-crystal device, a pair of polarizer means or a single polarizer means is accounted for.

It is assumed that the electro-optical device of this embodiment presents an eight-gray scale display, and that gray scale (shading) data represented by three bits indicates a transmittance ratio thereof. In this case, let V0–V7 represent voltages applied to the liquid-crystal layer at respective transmittance ratios. Conventionally, these voltages V0–V7 are directly applied to the liquid-crystal layer. At voltages V1–V6 corresponding to intermediate gray scales, nonuniformities are likely to occur between pixels because of the characteristics of analog circuits, such as a digital-to-analog converter and an operational amplifier, and variations in wiring resistances. An electro-optical device having such a conventional construction has difficulty in the presentation of a high-quality and high-definition gray scale display.

First, the electro-optical device of this embodiment uses only two voltages V0 (=0) and V7 to be applied to the liquid-crystal layer. With this arrangement, when the voltage V0 is applied to the liquid-crystal layer throughout one field, the transmittance ratio becomes zero %, and when the voltage V7 is applied, the transmittance ratio becomes 100%. Within one field, a ratio of a period during which the voltage V0 is applied to the liquid-crystal layer to a period during which the voltage V7 is applied to the liquid-crystal layer is controlled so that a root-mean-square voltage applied to the liquid-crystal layer ranges from V1 through V6. In this way, the gray scale display corresponding to the respective voltage is thus presented. Second, the electro-optical device of this embodiment divides one field into seven segments as shown in FIG. 4(*b*) to delimit the period during which the voltage V0 is applied to the liquid-crystal layer from the period during which the voltage V7 is applied to the liquid-crystal layer. The seven segments thus delimited are designated subfields Sf1–Sf7 for convenience.

Third, the electro-optical device of this embodiment writes the voltage V7 or the voltage V0 to the pixel electrode 118 in accordance with the gray scale data for each of the subfields Sf1–Sf7. For instance, when the gray scale data is (001) (i.e., a gray scale display is presented with a pixel transmittance ratio of 14.3%) and when the voltage of the pixel electrode 118 is V0, the writing of the pixel is performed so that the voltage of the pixel electrode 118 at the pixel is the voltage V7 at the subfield Sf1 within one field (1f), and that the voltage of the pixel electrode 118 is the voltage V0 at the remaining subfields Sf2–Sf7. The root-mean-square voltage is here determined by averaging squared instantaneous voltage values over one period (one field) and by calculating the square root of the averaged value. If the subfield Sf1 is set to be a length of $(V1/V7)^2$ within one field (1f), the root-mean-square value of the voltage applied to the liquid-crystal layer through the writing during one field (1f) becomes V1.

For example, when the gray scale data is (010) (i.e., a gray scale display is presented with a pixel transmittance ratio of 28.6%), and when the voltage of the counter electrode 108 is V0, the writing of the pixel is performed so that the voltage of the pixel electrode 118 at the pixel is the voltage V7 at the subfields Sf1 and Sf2 within one field (1f), and that the voltage of the pixel electrode 118 is the voltage V0 at the remaining subfields Sf3–Sf7. If the subfields Sf1 and Sf2 are set to be a length of $(V2/V7)^2$ within one field (1f), the root-mean-square value of the voltage applied to the liquid-crystal layer through the writing during one field (1f) becomes V2. Since the subfield Sf1 is set to be $(V1/V7)^2$ as already discussed, the subfield Sf2 is set to be $(V2/V7)^2-(V1/V7)^2$.

Similarly, when the gray scale data is (011) (i.e., a gray scale display is presented with a pixel transmittance ratio of 42.9%), and when the voltage of the counter electrode 108 is V0, the writing of the pixel is performed so that the voltage of the pixel electrode 118 at the pixel is the voltage V7 at the subfields Sf1–Sf3 within one field (1f), and that the voltage of the pixel electrode 118 is the voltage V0 at the remaining subfields Sf4–Sf7. If the subfields Sf1–Sf3 are set to be a length of $(V3/V7)^2$ within one field (1f), the root-mean-square value of the voltage applied to the liquid-crystal layer through the writing during one field (1f) becomes V3. Since the subfields Sf1–Sf2 are set to be $(V2/V7)^2$ as already discussed, the subfield Sf3 is set to be $(V3/V7)^2-(V2/V7)^2$.

The segments of the remaining subfields Sf4–Sf6 are similarly determined. Finally, the subfield Sf7 is set to be a segment of $(V7N7)^2-(V6/V7)^2$. A similar writing process is performed for the remaining gray scale data.

The subfields Sf1–Sf7 are thus determined. When the writing corresponding to the gray scale data is performed, the gray scale display corresponding to each transmittance ratio becomes possible even though the voltages applied to the liquid-crystal layer are only V0 and V7. For convenience of explanation, a logical amplitude of the applied voltage is so set that the voltage V7 has a high level and that the voltage V0 has a low level.

The gray scale data for each pixel needs to be converted in one way or another to write a high level or a low level in accordance with gray scales during each of the subfields Sf1–Sf7. The data converter circuit 300 shown in FIG. 1 does this conversion. Specifically, the data converter circuit 300 converts three-bit gray scale data D0–D2, for each pixel and supplied in synchronization with the vertical scanning signal Vs, the horizontal scanning signal Hs, and the dot clock signal DCLK, into binary signals Ds for each of the subfields Sf1–Sf7.

The data converter circuit 300 needs an arrangement which identifies a subfield within one field. Such an arrangement works to identify the subfield in the following way. Specifically, the data converter circuit 300 may include a 3-bit counter for counting the clock signal CLY with an initial value "1" preset by the start pulse DY as an enable signal. In other words, a septinary counter for counting the start pulse DY is arranged, and a current subfield is identified by referencing the count of the counter.

Since this embodiment employs the alternating driving method, the voltage of the counter electrode 108 is inverted in polarity every field by the alternating driving signal FR. The data converter circuit 300 may include a counter which counts the start pulse DY while resetting the count thereof at the level transition (the rising edge or the falling edge) of the alternating driving signal FR. The current subfield is thus identified by referencing the count of the counter.

Furthermore, the data converter circuit 300 needs to convert the gray scale data D0–D2 into the binary signals Ds in response to the level of the alternating driving signal FR. Specifically, the data converter circuit 300 outputs the binary signals Ds corresponding to the gray scale data D0–D2 as listed in FIG. 5(*a*) when the alternating driving signal FR is at a low level. The data converter circuit 300 outputs the binary signals Ds as listed in FIG. 5(*b*) when the alternating driving signal FR is at a high level.

Since the binary signals Ds need to be output in synchronization with the operation of the scanning line driving circuit 130 and the data line driving circuit 140, the data converter circuit 300 receives the start pulse DY, the clock signal CLY synchronized with the horizontal scanning, the latch pulse LP that defines the start of the horizontal scanning, and the clock signal CLX corresponding to the dot clock signal. As discussed above, after the first latch circuit 1420 latches the binary signal in a point at a time scanning in one horizontal scanning period in the data line driving circuit 140, the second latch circuit 1430 simultaneously latches the data latched by the first latch circuit 1420 in response to the latch pulse LP, thereby simultaneously feeding the data signals d1, d2, d3, . . . , dn to the data lines 114. For this reason, the data converter circuit 300 is designed to output the binary signals Ds at a timing which is in advance of the operation of the scanning line driving circuit 130 and the data line driving circuit 140 by one horizontal scanning period.

In the above embodiment, the scanning line driving circuit 130 and the data line driving circuit 140 (or one of these circuits) are preferably fabricated of transistors which are produced together with the transistors 116 within the pixels 110 on the element substrate. When the element substrate is a semiconductor substrate, the transistor may be a MOS transistor. When the element substrate is an insulator substrate such as a glass substrate, the transistor may be a thin-film transistor.

Operation

The operation of the electro-optical device of the above embodiment is now discussed. FIG. 6 is a timing diagram showing the operation of the electro-optical device.

The alternating driving signal FR, shifted in level every field (1f), is applied to the counter electrode 108. The start pulse DY is supplied at the start of any of the subfields into which one field (1f) is divided and which have lengths responsive to the magnitudes of the voltages V2–V6 that define the transmittance ratios at the gray scales.

When the start pulse DY for defining the start of the subfield Sf1 is supplied in one field (1f) with the alternating driving signal FR at a low level, the scanning signals G1, G2, G3, . . . , Gm are sequentially output for a period (1 Va) in response to the clock signal CLY in the scanning line driving circuit 130 (see FIG. 1). The period (1 Va) is set to be shorter in length than the shortest subfield.

The scanning signals G1, G2, G3, . . . , Gm have respectively a pulse width equal to half the period of the clock signal CLY. The scanning signal G1, corresponding to a first scanning line 112 from the top, is output with at least a delay of half the period of the clock signal CLY from the rising edge of the clock signal CLY subsequent to the supply of the start pulse DY. One shot (G0) of the latch pulse LP is fed to the data line driving circuit 140 from the supply of the start pulse DY at the start of a subfield to the output of the scanning signal G1.

The supply of the one shot (G0) of the latch pulse LP is now considered. When the one shot (G0) of the latch pulse LP is supplied to the data line driving circuit 140, the data line driving circuit 140 (see FIG. 3) transfers the one shot (G0) therewithin in synchronization with the clock signal CLX, thereby sequentially outputting the latch signals S1, S2, S3, . . . , Sn for the horizontal scanning period (1H). Each of the latch signals S1, S2, S3, . . . , Sn has a pulse width equal to half the period of the clock signal CLX.

At the falling edge of the latch signal S1, the first latch circuit 1420 shown in FIG. 3 latches the binary data Ds to the pixel 110 at an intersection of the first scanning line 112 from the top and the first data line 114 from the left. At the falling edge of the latch signal S2, the first latch circuit 1420 latches the binary data Ds to the pixel 110 at an intersection of the first scanning line 112 from the top and the second data line 114 from the left. Similarly, the first latch circuit 1420 latches the binary signal Ds to the pixel 110 at an intersection of the first scanning line 112 for the top and the n-th data line 114 from the left.

In this way, the first latch circuit 1420 sequentially latches the binary signals Ds for pixels of one row that intersect the first scanning line 112 from the top as shown in FIG. 1, in a point at a time scanning. The data converter circuit 300 converts and outputs the gray scale data D0–D2 for the pixels into the binary signals Ds in synchronization with the latching of the first latch circuit 1420. Since the alternating driving signal FR is here at a low level, the table listed in FIG. 5(*a*) is referenced, and the binary signals Ds corresponding to the subfield Sf1 are output in response to the gray scale data D0–D2.

When the scanning signal G1 is output with the clock signal CLY falling, the first scanning line 112 from the top is selected. As a result, the transistors 116 of the pixels 110 intersecting the scanning line 112 are all turned on. In response to the falling edge of the clock signal CLY, the latch pulse LP is output. At the timing of the falling edge of the latch pulse LP, the second latch circuit 1430 simultaneously feeds the binary signals Ds, which have been sequentially latched by the first latch circuit 1420 in a point at a time scanning, to the corresponding data lines 114 as the data signals d1, d2, d3, . . . , dn. At the first row of pixels 110 from the top, the writing of the data signals d1, d2, d3, . . . , dn is simultaneously performed.

In parallel with this writing, the binary signals Ds for a row of pixels intersecting the second scanning line 112 from the top shown in FIG. 1 are sequentially latched in a point at a time scanning by the first latch circuit 1420.

A similar step is repeated until the scanning signal Gm is output to the m-th scanning line 112. Specifically, during one horizontal scanning period (H) within which a scanning signal G1 (i is an integer satisfying the condition of $1 \leqq i \leqq m$) is output, the electro-optical device performs in parallel both the writing of data signals d1–dn to an i-th row of pixels 110 corresponding to an i-th scanning line 112 and the successive latching of the binary signals Ds in a point at a time scanning for one row of pixels 112 corresponding to an (i+1)-th scanning line 112. The data written on the pixels 110 is held until a next writing during a next subfield Sf2.

A similar operation is repeated each time the start pulse DY defining the start of the subfield is supplied. The data converter circuit 300 (see FIG. 1) references the corresponding subfield of the subfields Sf1–Sf7 when converting the gray scale data D0–D2 to the binary signals Ds.

When the alternating driving signal FR is level shifted to a high level one field later, a similar operation is also repeated in each subfield. In this case, however, the table listed in FIG. 5(*b*) is referenced in the conversion of the gray scale data D0–D2 to the binary signals Ds.

The voltage applied to the liquid-crystal layer in the pixel 110 in the above operation is now discussed. FIG. 7 is a timing diagram showing the gray scale data, and the voltage applied to the pixel electrode 118 in the pixel 110.

When the gray scale data D0–D2 at one pixel is (000) with the alternating driving signal FR at a low level, the conversion of the gray scale data is performed according to the table listed in FIG. 5(*a*). A low level is written on the pixel electrode 118 at that pixel throughout one field (1f) as shown in FIG. 7. Since the low level is the voltage V0, the root-mean-square voltage applied to the liquid-crystal layer becomes V0. The transmittance ratio of that pixel becomes 0% in association with the gray scale data (000).

When the gray scale data D0–D2 at one pixel is (100) with the alternating driving signal FR at a low level, the conversion of the gray scale data is performed according to the table listed in FIG. 5(*a*). Referring to FIG. 7, on the pixel electrode 118 at that pixel, a high level is written during subfields Sf1–Sf4 and a low level is written during subsequent subfields Sf5–Sf7. The ratio of the period of the subfields Sf1–Sf4 to the one field (1f) is $(V4/V7)^2$, and the voltage V7, which is at a high level, is written throughout this period, and the root-mean-square value of the voltage applied to the pixel electrode 118 of the pixel in one field becomes V4. The transmittance ratio of the pixel is thus 57.1% corresponding to the gray scale data of (100). Further discussion about the remaining gray scale data is omitted.

When the gray scale data D0–D2 is (111) at one pixel, the conversion of the gray scale data is performed according to the table listed in FIG. 5(*a*). Referring to FIG. 7, on the pixel electrode 118 at that pixel, a high level is written throughout one field (1f). The transmittance ratio of the pixel is thus 100% corresponding to the gray scale data of (111).

When the alternating driving signal FR is at a high level, the pixel electrode 118 is applied with the voltage in level shifted from the one with the alternating driving signal FR at a low level. With respect to an intermediate voltage between the voltage V7, which is at a high level, and the voltage V0, which is at a low level, the voltage applied to the liquid-crystal layer with the alternating driving signal FR at a high level is inverted in polarity from the voltage applied to the liquid-crystal layer with the alternating driving signal FR at a low level. The absolute values of the voltages applied to the liquid-crystal layer are equal. This arrangement prevents a direct current component from being applied to the liquid-crystal layer, thereby slowing the aging of the liquid crystal 105.

The electro-optical device of this embodiment divides the one field (1f) into the subfields Sf1–Sf7 in accordance with the voltage ratio of the gray scale characteristics, and writes a high level or a low level on a subfield by subfield basis, thereby controlling the root-mean-square voltage in the one field. For this reason, the data signals d1–dn supplied to the data lines 114 are binary, i.e., either a high level (=V7) or a low level (=V0) in this embodiment. The peripheral circuits, such as driving circuits, do not need circuits for processing analog signals, such as a high-precision digital-to-analog converter circuit or an operational amplifier. The circuit arrangement is thus substantially simplified, thereby reducing the overall cost of the device. Since the data signals d1–dn supplied to the data lines 114 are binary, no display nonuniformities occur-due to irregularities in element characteristics and wiring resistance. The electro-optical device of this embodiment thus presents a high-quality and high-definition gray scale display.

In the above embodiment, the alternating driving signal FR is level-shifted every field. The present invention is not limited to this method. For example, the alternating driving signal FR may be level-shifted every two or more fields.

Modification (1)

In the above embodiment, the writing of the subfield needs to be completed for a short period (1 Va) which is shorter than the shortest subfield. The above embodiment has been discussed in connection with the eight-gray scale display. To increase the number of gray scales to 16 gray scales, 64 gray scales, . . . , for example, the length of the subfield needs to be shortened to complete the writing of each subfield in an even shorter time.

However, the driving circuits, particularly the X shift register 1410 in the data line driving circuit 140 runs in an operating frequency close to its upper limit, and the number of gray scales cannot be increased in this arrangement. A modification with improvements in this regard is now discussed.

FIG. 8 is a block diagram showing the construction of the data line driving circuit in an electro-optical device in accordance with the modification. As shown, an X shift register 1412 is identical to the X shift register 1410 shown in FIG. 3 in that the latch pulse LP is transferred in synchronization with the clock signal CLX. The difference of the X shift register 1412 from the X shift register 1410 is that the X shift register 1412 has half the number of stages of the X shift register 1410. Specifically, let p represent an integer satisfying the condition of n=2p, and the X shift register 1412 sequentially outputs latch signals S1, S2, . . . , Sp.

In this modification, the binary signals Ds are distributed in two lines, i.e., binary signals Ds1 to odd-numbered data lines 114 and binary signals Ds2 to even-numbered data lines 114, counted from the left. In a first latch circuit 1422, one latch for latching the binary signal Ds1 corresponding to the odd-numbered data line 114 and one latch for latching the binary signal Ds2 corresponding to the even-numbered data line 114 are arranged in pairs, and the pair of latches perform latching at the falling edge of the same latch signal.

As shown in FIG. 9, the data line driving circuit 140 allows each of the latch signals S1, S2, S3, . . . to concurrently latch the two binary signals Ds1 and Ds2. The required horizontal scanning period is halved with the frequency of the clock signal CLX in the above embodiment maintained. The number of stages of the X shift register 1412 is reduced to "p", which is half the number of the data lines 114, namely, "n". The construction of the X shift register 1412 can be simplified from that of the X shift register 1410 (see FIG. 3).

The number of stages of the X shift register 1412, half the number of stages of the X shift register 1410, suggests that half the frequency of the clock signal CLX works given the same horizontal scanning period. If the horizontal scanning period remains the same, power affected by the operating frequency is reduced.

In the modification, the number of latches performing concurrently latching in response to the latch signal in the first latch circuit 1422 is "2", but that number may be "3" or more. In this case, the binary signals may be distributed in lines of the corresponding number, and the number of stages of the X shift register 1412 is reduced to a number that is obtained by dividing the original number of stages by the number of signal lines.

Modification (2)

In the preceding embodiments, the writing in each subfield is completed within the period (1 Va). The voltage written onto the liquid-crystal layer in each pixel is held for a period from the end of the writing to the start of a next subfield in one subfield.

The driving circuits in the above embodiments, particularly, the data line driving circuit 140 receives a very high-frequency clock signal CLX. The shift register typically includes a number of clocked inverters for receiving the clock signal at the gates thereof. If viewed from the timing signal generator circuit 200 as a source of the clock signal CLX, the X shift register 1410 (1412) works as a capacitive load.

The arrangement, which allows the clock signal CLX to be supplied during the above-discussed voltage hold period, consumes power in vain by the capacitive load, thereby increasing power consumption. Another modification free from this disadvantage is now discussed.

In this modification, a clock signal supply control circuit 400 shown in FIG. 10 is inserted in a path of the clock signal CLX extending to the X shift register 1410 (1412) from the timing signal generator circuit 200. The clock signal supply control circuit 400 includes an RS flipflop 402 and an AND gate 404. The RS flipflop 402 receives the start pulse DY at the set input terminal S thereof and the scanning signal Gm at the reset input terminal R thereof. The AND gate 404 AND-gates the clock signal CLX supplied by the timing signal generator circuit 200 and the signal from the output terminal Q of the RS flipflop 402, and supplies the AND-gated output thereof to the X shift register 1410 (1412) in the data line driving circuit 140.

When the start pulse DY is supplied to the clock signal supply control circuit 400 at the start of one subfield, the RS flipflop 402 is set, thereby transitioning an enable signal Enb output from the output terminal Q to a high level as shown in FIG. 11. In response, the AND gate 404 is opened, thereby starting the supply of the clock signal CLX to the X shift register 1410 (1412). In the data line driving circuit 140, the first latch circuit 1420 (1422) starts sequentially latching data in a point at a time scanning in response to the latch pulse LP which is supplied immediately subsequent to the start of the supply of the clock signal CLX.

On the other hand, when the scanning signal Gm for selecting the last scanning line (m-th scanning line from the top) 112 in the subfield is supplied subsequent to the start of the supply of the clock signal CLX in response to the start pulse DY, the RS flipflop 402 is reset. The enable signal Enb output from the output terminal Q of the RS flipflop 402 is driven low in level as shown in FIG. 11. In response, the AND gate 404 is closed, and the supply of the clock signal CLX to the X shift register 1410 (1412) is cut off. Since data for one row of pixels intersecting the m-th scanning line 112 is latched by the first latch circuit 1420 (1422) prior to the supply of the scanning signal Gm, the cutting of the supply of the clock signal CLX until the start of the next subfield presents no problem at all.

With such a clock signal supply control circuit 400 arranged, the clock signal CLX is fed to the X shift register 1410 (1412) only when the clock signal CLX is needed. Power consumed by the capacitive load is accordingly reduced. Although a similar clock signal supply control circuit may be arranged for the clock signal CLY on the Y side, its frequency is substantially lower than the frequency of the clock signal CLX on the X side. Power consumed by the capacitive load on the Y side is not so problematic as that on the X side.

Modification (3)

In the preceding embodiments, the voltage V0 is at a low level, and the voltage V7 is at a high level. With this arrangement, the voltage V7 for a transmittance ratio of 100% needs to be generated separately from a single power source. As apparent from FIG. 4(*a*), a root-mean-square value not less than V7 results in a transmittance ratio of 100%, and a high-potential voltage Vcc of a power source (3 V, for example) may be directly used as a high level voltage without the need for separately generating the voltage V7. If Vcc is defined as a high level, the use of the power source voltage permits a gray scale display.

In the arrangement in which the voltage Vcc is used as a high level, the voltage V7 may be treated in the same way as the voltages V2–V6 are in the preceding embodiments. Furthermore, one field (1f) may be divided into eight subfields Sf1–Sf8 having the following lengths.

Specifically, the subfield Sf1 is set to have a length of $(V1/Vcc)^2$ to the one field (1f), the subfield Sf2 is set to have a length of $(V2/Vcc)^2-(V1/Vcc)^2$ to the one field (1f), and the subfield Sf3 is set to have a length of $(V3/Vcc)^2-(V2/Vcc)^2$ to the one field (1f). Similarly, the subfields are set, and finally, the subfield Sf8 is set to have a length of $(Vcc/Vcc)^2-(V7/Vcc)^2$ to the one field (1f).

From among the subfields Sf1–Sf8 thus set, subfields Sf1–Sf7 are subjected to the writing in the same way as already discussed in connection with the first embodiment. For the new subfield Sf8, the voltage is at the same level as the alternating driving signal FR, i.e., at the same level as the voltage of the counter electrode 108. During the subfield Sf8, the liquid-crystal layer is supplied with no voltage regardless of the gray scale data. In other words, to attain a transmittance ratio of 100%, it is not necessary to continuously keep the liquid-crystal layer turned on throughout one field (1f).

Modification (4)

In the preceding embodiments, voltage is applied to turn on the pixel for a period in response to the gray scale data. Specifically, as shown in FIG. 7, to apply the root-mean-square voltage V1 corresponding to the gray scale data (001) to the pixel, an on voltage is applied during the subfield Sf1, and to apply the root-mean-square voltage V3 corresponding to the gray scale data (011), the on voltage is applied during the subfields of Sf1–Sf3, and to apply the root-mean-square voltage V6 corresponding to the gray scale data (110), the on voltage is applied during the subfields of Sf1–Sf6. In this way, one field is divided into subfields, the number of which corresponds to the number of gray scales to be displayed. The division of the field into the subfields is not limited to this method. For example, the following method is contemplated.

FIGS. 12(*a*) and 12(*b*) are truth tables that represent the function of the data converter circuit 300 of an electro-optical device in accordance with a modification. FIG. 13 is a timing diagram showing the operation of the electro-optical device of this modification.

In this modification, one field is divided into four subfields, and on/off driving performed in each of four subfields Sf0–Sf3 according to truth tables shown in FIGS. 12(*a*) or 12(*b*). In this way, an eight-gray scale display is provided in response to three-bit gray scale data. The time sharing of the subfields in this modification is partly different from that in the preceding embodiments. Specifically, as itemized in a–d, the subfields have time lengths that present root-mean-square voltages having different weights to the pixels.

a. The subfield Sf0 has a time length long enough to supply the liquid-crystal layer with a root-mean-square voltage corresponding to the threshold VHT1 of the liquid crystal as shown in FIG. 4(*a*).

b. The subfield Sf1 has a time length long enough to supply the pixel with a root-mean-square voltage corresponding to a weight "1".

c. The subfield Sf2 has a time length long enough to supply the pixel with a root-mean-square voltage corresponding to a weight "2".

d. The subfield Sf3 has a time length long enough to supply the pixel with a root-mean-square voltage corresponding to a weight "4".

As apparent from the above discussion, to apply a root-mean-square voltage to the liquid-crystal layer, the pixel is set to an ON state during the subfield Sf0. As shown in FIGS. 12(*a*) and 12(*b*), in the gray scale data other than (000), the binary signals Ds for the subfield Sf0 have the level to turn on the pixels.

Referring to FIG. 13, the voltage applied to each pixel in accordance with the gray scale data is discussed. When the gray scale data is (001), the voltage to turn on the pixel is applied during the subfields Sf0 and Sf1, and as a result, the root-mean-square voltage applied to the liquid-crystal layer becomes V1 during one field. Similarly, when the gray scale data is (010), the voltage to turn the pixel is applied during the subfields Sf0 and Sf2, and as a result, the root-mean-square voltage applied to the liquid-crystal layer becomes V2 during one field. Also in the remaining gray scale data, truth tables listed in FIGS. 12(*a*) and 12(*b*) are used to determine whether to apply the voltage to turn on or off the pixel in each subfield. As a result, the liquid-crystal layer is applied with the root-mean-square voltage responsive to the gray scale data.

This modification also provides the same advantage as that of the preceding embodiments. A smaller number of subfields work in this modification when the number of gray scales remains unchanged from that of the preceding embodiments. Since a count of data writing in one field is thus reduced, power consumption is reduced.

The number and time lengths of subfields are determined considering the number of gray scales to be displayed, and voltage/transmittance characteristics of the pixel in an electro-optical device in use, and are not limited to those already discussed in connection with the preceding embodiments. In this modification, the subfield Sf0 has a time length long enough to supply the pixel with a voltage as high as the threshold voltage VTH1 of the liquid crystal. Such a subfield is not a requirement. It is important that the number of and time lengths of the subfields are determined so that a root-mean-square voltage responsive to a gray scale to be displayed is applied to the pixel within a range of the voltage VTH1 through V7 as shown in FIG. 4(*a*). The voltage applied to the pixel electrode may be the power source voltage Vcc as a high level as already discussed in connection with the modification (3).

In this modification, the subfield Sf0 for applying the root-mean-square voltage VTH1 to the pixels is arranged at the first portion of each field. The position of this subfield may be located anywhere within each field. In this modification, only a single subfield Sf0 is arranged as a subfield that can apply the root-mean-square voltage VTH1 to the pixel. The present invention is not limited to this method. Alternatively, the following method may be employed. Specifically, rather than using the subfield Sf0, predetermined periods of time are inserted between the subfields Sf1–Sf3, and the sum of the predetermined periods may be a time length which allows the root-mean-square voltage VTH1 to be applied to the pixel. In other words, the subfield Sf0 having a time length that allows the root-mean-square voltage VTH1 to be applied is split into a plurality of segments, and these segments are inserted between subsequent subfields. It is important that the time length of the one field except subfields Sf1–Sf3 is a time length capable of applying the root-mean-square voltage VTH1 to the pixel.

General Construction of the Liquid-Crystal Device

The construction of the electro-optical devices in accordance with the above embodiment and modifications are now discussed, referring to FIG. 14 and FIG. 15. FIG. 14 is a plan view of the electro-optical device 100 and FIG. 15 is a sectional view of the electro-optical device 100 taken along line XV-XV' in FIG. 14.

As shown, the electro-optical device 100 includes the element substrate 101 having the pixel electrodes 118 formed thereon, and the counter substrate 102 having the counter electrode 108 formed thereon. The element substrate 101 and the counter substrate 102 are glued onto each other with a sealing member 104 interposed therebetween, with a gap maintained therebetween. The liquid crystal 105 as an electro-optical material is encapsulated in the gap. The sealing member 104 has a cutout, through which the liquid crystal 105 is introduced, and then, the cutout is closed by an encapsulating material. The cutout is not shown in FIG. 14 and FIG. 15.

When the element substrate 101 is fabricated of a semiconductor substrate, the substrate is opaque. The pixel electrode 118 is thus formed of a reflective metal such as aluminum, and the electro-optical device 100 is thus of a reflective type. In contrast, the counter substrate 102, fabricated of glass, is transparent. The element substrate 101 may be fabricated of a transparent insulator substrate such as glass. With the element substrate 101 fabricated of an insulator substrate, a reflective type display device is provided when the pixel electrode is formed of a reflective material. When the pixel electrode is formed of a material other than this, a transmissive type display device is provided.

A light-shielding layer 106 is arranged on the element substrate 101 internal to the sealing member 104 but external to a display area 101*a*. The scanning line driving circuit 130 is formed in a region 130*a* of the area where the light-shielding layer 106 is formed. The data line driving circuit 140 is arranged on a region 140*a*. The light-shielding layer 106 therefore prevents light from being incident on the driving circuits formed in these regions. The light-shielding layer 106 and the counter electrode 108 are supplied with the alternating driving signal FR. The area having the light-shielding layer 106, having substantially no voltage with respect to the liquid-crystal layer, provides the same display state as that of the pixel electrode 118 with no voltage applied.

A region 107 on the element substrate 101, external to the region 140*a* of the data line driving circuit 140, and separated by the sealing member 104, has a plurality of terminals to receive control signals and a power source voltage from outside.

On the other hand, the counter electrode 108 on the counter substrate 102 is electrically connected to the light-shielding layer 106, and interconnect terminals arranged on the element substrate 101 via conductor members (not shown) arranged at least one of the four corners of a substrate attachment portion. Specifically, the alternating driving signal FR is applied to the light-shielding layer 106 via the interconnect terminals arranged on the element substrate 101 and then to the counter electrode 108 via the conductor members.

Depending on the application of the electro-optical device 100, a color filter patterned in stripe, mosaic, or triangles is first mounted on the counter substrate 102 if the electro-optical device 100 is of a direct viewing type. Second, a light-shielding layer (black matrix) made of, for example, metal material or resin is mounted on the counter substrate 102. When the electro-optical device 100 is applied for light modulation, such as a light valve of a projector as discussed later, no color filter is arranged. In a direct viewing type, as necessary, a front light is arranged to illuminate the electro-optical device 100 from the counter substrate 102. An alignment layer (not shown), subjected to a rubbing process in a predetermined direction, is arranged on the electrode formation surfaces of the element substrate 101 and the counter substrate 102. The alignment direction of liquid-crystal molecules with no voltage applied is thus defined. Furthermore, a polarizer (not shown) compatible with the alignment direction is arranged on the element substrate 101. If a polymer dispersed liquid crystal consisting of a mixture of a liquid crystal and polymer is used as the liquid crystal 105, the above-mentioned alignment layer and the polarizer are dispensed with. With a high utilization of light, the electro-optical device 100 thus provides advantages, such as increased luminance, and reduced power consumption.

In the preceding embodiments, the element substrate 101 forming the electro-optical device is a semiconductor substrate, and the transistors 116 respectively connected to the pixel electrodes 118 and elements used in the driving circuits are MOSFET transistors. The present invention is not limited to this type. For example, the element substrate 101 may be fabricated of an amorphous substrate such as of glass or quartz, and then a semiconductor thin film may be deposited thereon to form a thin-film transistor (TFT). With the TFT, a transparent substrate may be used as the element substrate 101.

Employed as the liquid crystal, besides the TN type, may be an STN (Super Twisted Nematic) type having 180 degree or more twisted alignment, a BTN (Bistable Twisted Nematic) type, a ferroelectric type employing a bistable twisted nematic liquid crystal having memory, a polymer dispersed type, or a guest-host type in which a dye (guest) having anisotropy in the absorption of visible light in the minor axis and the major axis of molecules is dissolved in a liquid crystal (host) having a predetermined molecular arrangement and the dye molecules and the liquid-crystal molecules are arranged in parallel.

Perpendicular alignment (homeotropic alignment) may be arranged in which the liquid-crystal molecules are perpendicularly aligned with respect to the two substrates with no voltage applied, and aligned in parallel to the two substrates with a voltage applied. On the other hand, parallel (planar) alignment (homogeneous alignment) may be arranged in which the liquid-crystal molecules are aligned in parallel to the two substrates with no voltage applied, and are perpendicularly aligned to the two substrates with a voltage applied. Rather than arranging the counter electrode on the counter substrate, the counter electrode may be arranged on the element substrate in a manner such that pixel electrodes and the counter electrode are interdigitally spaced with a gap maintained therebetween. With this arrangement, the liquid crystal molecules are aligned in parallel with the two substrates, and the alignment direction of the molecules varies in response to a parallel electric field taking place between the electrodes. As long as the driving method of the present invention is applicable, a variety of liquid crystals and a variety of alignment methods are acceptable.

Besides the liquid-crystal device, the present invention is applied to a diversity of electro-optical devices including electroluminescences (EL), digital micro-mirror devices (DMD), and devices which present a display using the electro-optical effect based on fluorescence by plasma emission or electron emission. In this case, the electro-optical materials may include EL, a mirror device, gas, fluorescent materials, etc. When the EL is used as an electro-optical material, the EL is interposed between the pixel electrode and the counter electrode of the transparent, electrically conductive layer, and the counter electrode is thus dispensed with. The present invention is thus applicable to electro-optical devices having a construction similar to the ones discussed above, and in particular, to all electro-optical devices that present a gray scale display using pixels that provides binary presentation of on and off.

Electronic Equipment

Several specific examples of electronic equipment using the above-described liquid-crystal device are now discussed.

Electronic Equipment 1: Projector

Discussed first is a projector which uses the electro-optical device of each of the above embodiments as a light valve. FIG. 16 is a plan view showing the projector. As shown, the projector 1100 includes a polarizer illumination unit 1110 along a system optical axis PL. In the polarizer illumination unit 1110, a light beam from a lamp 1112 is reflected and substantially collimated by a reflector 1114, and enters a first integrator lens 1120. The output light beam from the lamp 1112 is split into a plurality of intermediate light beams. The split intermediate light beams are converted into polarized light beams of one type having a substantially uniform polarization (s-polarized light beams) through a polarizer assembly 1130 having a second integrator lens on the light incident side thereof, and are then output from the polarizer illumination unit 1110.

The s-polarized light beams exiting from the polarizer illumination unit 1110 is reflected from the s-polarized light beam reflecting surface 1141 of a polarizing beam splitter 1140. The blue light beam (B) of the reflected light beams is reflected from the blue-light reflecting layer of a dichroic mirror 1151, and is then modulated by a reflective-type electro-optical device 100B. The red light beam (R) of the light beams transmitted through the blue-light reflecting layer is reflected from a red-light reflecting layer of the dichroic mirror 1152, and is then modulated by a reflective-type electro-optical device 100R. The green light beam (G) of the light beams transmitted through the blue-light reflecting layer of the dichroic mirror 1151 is transmitted through a red-light reflecting layer of a dichroic mirror 1152, and is then modulated by the a reflective-type electro-optical device 100G.

The red, green, and glue light beams respectively color-modulated by the electro-optical devices 100R, 100G, and 100B are synthesized by the dichroic mirrors 1152 and 1151, and the polarizing beam splitter 1140, and then projected onto a screen 1170 through a projection optical system 1160. The electro-optical devices 100R, 100G, and 100B need no color filter because these devices receive the three primary colors of R, G, and B.

Although this embodiment uses the reflective-type electro-optical device, the projector may employ a transmissive-type electro-optical device.

Electronic Equipment 2: Mobile Computer

Discussed here is a mobile computer incorporating the above-referenced electro-optical device. FIG. 17 is a perspective view of the construction of the mobile computer. The computer 1200 includes a main unit 1204 having a keyboard 1202, and a display unit 1206. The display unit 1206 is composed of the above-referenced electro-optical device 100 with a front light attached on the front thereof.

In this embodiment, the electro-optical device 100 is of a reflective direct-viewing type, and preferably, irregularity is formed on the pixel electrode 118 so that a light beam reflected therefrom is scattered in various directions.

Electronic Equipment (3): Portable Telephone

Discussed next is a portable telephone incorporating the above-referenced electro-optical device. FIG. 18 is a perspective view of the portable telephone. As shown, the portable telephone 1300 includes a plurality of control buttons 1302, an earpiece 1304, a mouthpiece 1306, and the electro-optical device 100. The electro-optical device 100 is provided with a front light on the front thereof as necessary. Since the electro-optical device 100 is of a reflective direct-viewing type in this embodiment again, irregularity is preferably formed on the pixel electrode 118.

Besides the electronic equipment described with reference to FIG. 16 through FIG. 18, the electronic equipment of the present invention may be any of a diversity of electronic equipment including a liquid-crystal display television, a viewfinder type or direct-monitoring type video cassette recorder, a car navigation system, a pager, an electronic pocketbook, an electronic tabletop calculator, a word processor, a workstation, a video phone, a POS terminal, and an apparatus having a touch panel. These pieces of electronic equipment may incorporate the electronic devices of the above embodiment and modifications.

In accordance with the present invention, as described above, the signal applied to the data line is binarized, and a high-quality gray scale display thus results.

INDUSTRIAL APPLICABILITY

The present invention provides an optimum driving method in an electro-optical device that performs gray scale display control using pulse width modulation, and is appropriate for use as a display device having excellent characteristics in electronic equipment.

What is claimed is:

1. A driving method for driving an electro-optical device having a pixel with a pixel electrode arranged corresponding to an intersection where a scanning line and a data line cross, the pixel having a switching element, an electro-optical material, a storage capacitor and a counter electrode arranged to be opposed to the pixel electrode, in a plurality of driving fields to display an image with gray scale, the method comprising the steps of:

dividing each driving field into a plurality of subfields;

supplying a scanning signal to the scanning line in each subfield; and feeding a binary signal for controlling the pixel to be in an ON state or an OFF state from the data line through the switching element to the electro-optical material and the storage capacitor, the storage capacitor holding the binary signal;

and the binary signal setting the pixel to the ON state or the OFF state so that a ratio of a period of voltage application time to set the pixels to the ON state to a period of voltage application time to set the pixels to the OFF state in each driving field is responsive to the gray scale level of the pixel, the binary signal being shifted in response to a level of voltage applied to the counter electrode.

2. The driving method for driving an electro-optical device according to claim 1, the subfields divided from one driving field having time lengths long enough so as to feed a different root-mean-square voltage to each subfield.

3. A driving circuit of an electro-optical device for driving pixels in a plurality of driving fields, comprising:

a data line, a scanning line, a pixel with a pixel electrode arranged corresponding to an intersection where the scanning line and the data line cross, and having a switching element, an electro-optical material, a storage capacitor, and a counter electrode arranged to be disposed opposed to the pixel electrode;

a scanning line driving circuit that supplies the scanning line with a scanning signal that turns on the switching element in each of a plurality of subfields divided from one driving field; and a data line driving circuit that supplies the data line with a binary signal controlling the pixel to be set to an ON state or an OFF state from the data line through the switching element to an electro-optical material and the storage capacitor, the storage capacitor holding the binary signal; and the binary signal setting the pixel to the ON state or to the OFF state so that a ratio of a period of voltage application time to set the pixels to the ON state to a period of voltage application time to set the pixels to the OFF state in each driving field is responsive to a gray scale level of the pixel, the binary signal being shifted in response to a level of voltage applied to the counter electrode.

4. The driving circuit of an electro-optical device according to claim 3, the data line driving circuit further comprising:

a shift register that sequentially shifts and outputs a latch pulse signal, supplied at the start of a horizontal scanning period, in response to a clock signal;

a first latch circuit that sequentially latches the binary signal in response to the shifted signal provided by the shift register; and a second latch circuit which latches the binary signal, latched by the first latch circuit, in response to the latch pulse signal while simultaneously outputting the latched binary signals to corresponding data lines.

5. The driving circuit of an electro-optical device according to claim 4, the first latch circuit simultaneously latching the binary signals, which are branched into a plurality of lines from a single line, in response to the shifted signal provided by the shift register.

6. The driving circuit of an electro-optical device according to claim 4, comprising a clock signal supply control circuit, the clock signal supply control circuit stopping supply of the clock signal to the shift register after the scanning line driving circuit supplies all scanning lines with the scanning signal in one subfield, and restarting the supply of the clock signal at a start of a subsequent subfield.

7. An electro-optical device, comprising:

a data line, a scanning line, a pixel having a pixel electrode corresponding to an intersection where the scanning line and the data line cross, a switching element, a storage capacitor, and a counter electrode arranged to be opposed to the pixel electrode;

a scanning line driving circuit that supplies the scanning line with a scanning signal that turns on the switching element in each of a plurality of subfields divided from one driving field of a plurality of driving fields; and a data line driving circuit that supplies the data line with a binary signal controlling the pixel to be in an ON state or an OFF state from the data line through the switching element to an electro-optical material and the storage capacitor, the storage capacitor holding the binary signal;

the binary signal setting the pixel to an ON state or to an OFF state so that a ratio of a period of voltage application time to set the pixel to the ON state to a period of voltage application time to set the pixel to the OFF state in each driving field is responsive to a gray scale level of the pixel, the binary signal being shifted in level in response to a level of a voltage applied to the counter electrode.

8. The electro-optical device according to claim 7, an element substrate on which the pixel electrode and the switching element are formed being fabricated of a semiconductor substrate, and the scanning line driving circuit and the data line driving circuit being produced on the element substrate, and the pixel electrode having reflectivity.

9. Electronic equipment comprising the electro-optical device according to claim 7.

* * * * *